US007013739B2

(12) United States Patent
Schroeder et al.

(10) Patent No.: US 7,013,739 B2
(45) Date of Patent: Mar. 21, 2006

(54) SYSTEM AND METHOD FOR CONFINING AN OBJECT TO A REGION OF FLUID FLOW HAVING A STAGNATION POINT

(75) Inventors: Charles M. Schroeder, Stanford, CA (US); Eric S. G. Shaqfeh, Stanford, CA (US); Hazen P. Babcock, Cambridge, MA (US); Steven Chu, Stanford, CA (US)

(73) Assignee: The Board of Trustees of the Leland Stanford Junior University, Palo Alto, CA (US)

( * ) Notice: Subject to any disclaimer, the term of this patent is extended or adjusted under 35 U.S.C. 154(b) by 83 days.

(21) Appl. No.: 10/841,011

(22) Filed: May 7, 2004

(65) Prior Publication Data

US 2006/0005634 A1 Jan. 12, 2006

Related U.S. Application Data

(60) Provisional application No. 60/498,875, filed on Aug. 29, 2003.

(51) Int. Cl.
*G01F 1/00* (2006.01)

(52) U.S. Cl. ..... 73/861; 73/861.05

(58) Field of Classification Search ..... None
See application file for complete search history.

(56) References Cited

U.S. PATENT DOCUMENTS 6,645,432 B1 11/2003 Anderson et al.
2003/0156992 A1 8/2003 Anderson et al.
2005/0112606 A1 * 5/2005 Fuchs et al. ..... 435/6

OTHER PUBLICATIONS

Ashkin, PNAS 94: 4853-4869, 1997.
Bentley and Leal, J. Fluid Mech. 167: 219-240, 1986.
Buderi, The Personal Genome Sequencer, Technology Review, Nov. 2002.
Chiu et al., PNAS 98(6): 2961-2966, 2001.
Haber and Wirtz, Biophysical Journal 79: 1530-1536, 2000.
Maerkl and Thorsen, Lab Shrunk to a Chip, news@nature.com, Sep. 27, 2002.
Phillip, Liquid Logic, news@nature.com, Mar. 27, 2001.
Schroeder et al., Science 201: 1515-1519 (with online supplemental materials), 2003.
Tseng et al., Biophysical Journal 83: 3162-3176, 2002.

* cited by examiner

*Primary Examiner*—Harshad Patel
(74) *Attorney, Agent, or Firm*—Fish & Neave IP Group Ropes & Gray, LLP

(57) ABSTRACT

A device for confining an object to a region proximate to a fluid flow stagnation point includes one or more inlets for carrying the fluid into the region, one or more outlets for carrying the fluid out of the region, and a controller, in fluidic communication with the inlets and outlets, for adjusting the motion of the fluid to produce a stagnation point in the region, thereby confining the object to the region. Applications include, for example, prolonged observation of the object, manipulation of the object, etc. The device optionally may employ a feedback control mechanism, a sensing apparatus (e.g., for imaging), and a storage medium for storing, and a computer for analyzing and manipulating, data acquired from observing the object. The invention further provides methods of using such a device and system in a number of fields, including biology, chemistry, physics, material science, and medical science.

89 Claims, 10 Drawing Sheets

DNA 1.3mm

DNA 1.3mm

DNA 1.3mm

SYSTEM AND METHOD FOR CONFINING AN OBJECT TO A REGION OF FLUID FLOW HAVING A STAGNATION POINT

CROSS-REFERENCE TO RELATED APPLICATIONS

This application incorporates by reference in entirety, and claims priority to and benefit of, U.S. Provisional Patent Application No. 60/498,875, filed on Aug. 29, 2003.

GOVERNMENT SUPPORT

Part of this work was supported by grants from the Center on Polymer Interfaces and Macromolecular Assemblies; the U.S. Air Force Office of Scientific Research; Office of Naval Research; NASA; Materials Research Science and Engineering Center; and the National Science Foundation (NSF). The U.S. Government has certain rights in this invention.

BACKGROUND

Fluid may be used to manipulate the movement of small particles. One method for controlling the location of a zero-velocity position in flow is described by Bentley and Leal ("A computer-controlled four-roll mill for investigations of particle and drop dynamics in two-dimensional linear shear flows", *J. Fluid Mech.*, v. 167, pp. 219–240, 1986). The Bentley/Leal device provides four rollers, which rotate at various speeds in specific directions to produce a specific flow type. The device can be used to create a purely extensional flow to manipulate millimeter-size particles; for example, the device may be used to manipulate the behavior of a drop of oil in water, under a force of extensional flow.

The Bentley/Leal device employs a complex computer-controller to keep the center of mass of a particle superposed on the fluid flow stagnation point, while maintaining a specific flow type. To this end, the computer-controller regulates the speed and direction of movement of the four rollers in a tank of fluid.

The Bentley/Leal device has drawbacks and limitations that are not insignificant. For example, the operation of the device depends on a complicated computer-controlled system. Variation in the movement and/or speed of each of the four rollers contributes to the overall behavior of the system. Additionally, the four, relatively large, rollers are moving parts within close proximity of the millimeter-size particle, thereby interfering with, for example, observation of the particle. Further, the rollers in the Bentley/Leal device sit in the same bath of fluid as the sample or particle under observation. With this configuration, the environmental conditions surrounding the sample under investigation (such as the fluid type, ionic strength and/or type, pH, other additives such as specific enzymes, etc.) cannot be altered seamlessly or easily, because the Bentley/Leal device does not provide a means for introducing fluid into the closed bath of fluid.

Another drawback of the Bentley/Leal device is that it employs a relatively deep bath of fluid, resulting in a fluid flow that is non-planar, thereby causing the particle trapped by the flow to drift up and/or down, without leaving the stagnation "point" (or a locus of stagnation points). More particularly, with an optional imaging device located directly above or below the Bentley/Leal four-roll mill device, the trapped particle may drift out of focus, especially during prolonged observation.

Therefore, there exists a need for improved methods and/or systems for confining an object of interest in a region of fluid flow. There is also a need to confine an object in the region for an indefinite length of time and without the aid of an optical trap, a micropipette, or other tethering device. Furthermore, there is a need for systems and/or methods for trapping of an object in bulk solution, sufficiently distant from walls or stationary objects that may interfere with the state or behavior of the object.

SUMMARY OF THE INVENTION

The systems and methods described herein are generally directed, at least in one embodiment, to confining an object to a study region proximate to a stagnation point of a fluid flow, for example, for observation (typically for a prolonged duration) and/or manipulation (e.g., physical, chemical, biological, or a combination thereof), etc. At least a portion of the object to be confined may have a gaseous form (e.g., it may be a gas bubble); alternatively, at least a portion of the object may have a colloidal particulate form (having, for example, a semi-solid, solid, semi-liquid, or liquid form), etc.

In one embodiment, the systems and methods disclosed herein employ pressure-driven fluid flow to produce a stagnation point, and to control the position of the stagnation point to discourage an object (placed at least partially thereon) from leaving a study region proximal to, or superposing, the stagnation point. A device according to the methods and systems described herein includes at least one inlet for carrying the fluid to the study region, at least one outlet carrying the fluid from the region, and a controller employing pressure-driven fluid flow to adjust the motion of the fluid in at least one of the inlets or outlets to produce a fluid flow stagnation point proximate to, or at least partially superposing, the study region, to discourage the object from leaving the region.

Also disclosed herein are methods of confining an object to a study region proximate to a stagnation point of a fluid in motion. In one practice, the method includes carrying the fluid to the region by at least one inlet; carrying the fluid from the region by at least one outlet; placing the object in the region; and adjusting the motion of the fluid to produce a flow stagnation point proximate to, or at least partially superposing, the region, to discourage the object from leaving the region.

In an embodiment, the systems and methods described herein are generally directed to subjecting the object to a force of fluid flow, for aligning the object along a predetermined orientation, for rotating the object about an axis, or for physically distorting the object in a desired manner, such as by stretching it, compressing it along an axis, or slicing it at, or along, a locus.

Further features and advantages of the invention will be apparent from the following description of illustrative embodiments, and from the claims.

BRIEF DESCRIPTION OF THE DRAWINGS

The following figures depict certain illustrative embodiments of the invention in which like reference numerals refer to like elements. These depicted embodiments are to be understood as illustrative of the invention and not as limiting in any way.

DETAILED DESCRIPTION OF THE ILLUSTRATED EMBODIMENTS

To provide an overall understanding of the invention, certain illustrative practices and embodiments will now be described, including a system for confining an object to a region of a fluid in motion and a method for doing the same. However, it will be understood by one of ordinary skill in the art that the systems and methods described herein can be adapted and modified and applied in other applications, and that such other additions, modifications, and uses will not depart from the scope hereof.

Figure 1:
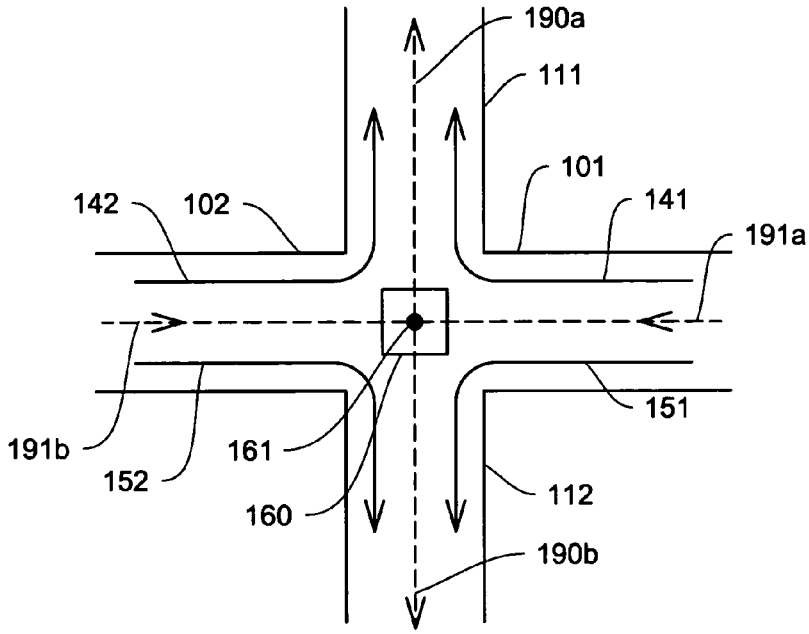
FIG. 1 depicts a cross-shaped embodiment of the stagnation point device having two inlets and two outlets, and illustrating an exemplary study region, stagnation point, sample fluid flow paths.

FIG. 1 depicts a top-view of a cross-shaped network of inlets and outlets representing an embodiment of the systems and methods described herein. A pressure-driven fluid flows along sample flow trajectories 141, 142, 151, and 152 toward, and past, stagnation region 160. Stagnation point 161 denotes the point of zero fluid velocity produced by the meeting of fluid flow in inlets 101 and 102.

In a pressure-driven flow, the fluid tends, on average, to flow from regions of high to low pressure. Where the fluid in one flow path connects, at a junction (e.g., a study region), to two or more flow paths, the average fluid velocity in each outlet adjusts to maintain equal pressure drop in each outlet. The flow produced in an embodiment according to FIG. 1 is an extensional flow. An extensional flow is characterized by a line of fluid extension (e.g., directed dashed lines 190*a–b*) and a substantially orthogonal line of fluid compression (e.g., dashed lines 191*a–b*). This flow is often called a "strong" flow, because of its ability to deform elements having contact with the fluid, and hence drastically stretch objects such as, without limitation, flexible polymer chains, even at low flow strengths. From a practical standpoint, extensional flows are relevant to many polymer-processing applications, including, for example, coating, injection molding, and fiber drawing.

The fluid employed may be a substance in liquid form, gaseous form, or a combination thereof. Depending on, among others, a combination of the viscosity of the fluid used, flow path/channel dimensions, and fluid density, the flow may include a laminar (non-turbulent) flow, a turbulent flow, or a combination thereof. The fluid may include, among others, water or other organic solvents, an aqueous solution, a non-aqueous solution, an electrolytic solution, or a combination of these. A non-aqueous solution may include an organic solvent. In an embodiment, the fluid may include an agent to manipulate the object. The agent may be a biological agent, a chemical agent, a biochemical agent, a magnetic agent, a radioactive agent, a fluorescent agent or any combination of these. The object trapped by the systems and methods described herein may include a macromolecule, a biomolecule, or a colloidal particulate such as a droplet (liquid, solid, semi-solid, or a combination of these), a gaseous bubble, or a combination of these.

Any of inlets the 101 and 102 and the outlets 111 and 112 is a fluid flow path, i.e., an artery capable of carrying fluid. An inlet carries fluid to a designated study region, whereas an outlet carries fluid from the region. The artery may include a channel or a microfluidic artery, among others; the artery may be open topped (e.g., a riverbed-like flow path) or enclosed (e.g., a tubular or chamber-like flow path).

The artery may be substantially planar. Substantially planar, as used herein, describes the dimensions of a fluid chamber or channel; the surface area of a portion of the chamber or channel, relative to the average depth (d) of the chamber or channel belonging to the area, can be used as a planarity measure. If the area of the chamber can be approximated by a square with a side length of r, the chamber is substantially planar if the ratio r/d is at least 2, preferably 3, 5, 10, 20, 50, 100, 200, or more. The quantities r and d are measured by the same unit, e.g., both in millimeters (mm) or both in micrometers ($\mu$m), etc.

The systems and methods described herein are based, at least in part, on principles of fluid mechanics. In one embodiment of FIG. 1, a system according to the invention is constructed on small-length scales, with a typical inlet, outlet, or study region dimension of about 5–10 mm. In such an embodiment, the flow is typically viscous-dominated (i.e., laminar, non-turbulent, characterized by a low Reynolds number).

In other embodiments, the flow structure may be scaled up for trapping larger-size objects, such as a cell or millimeter-size particulate, or scaled down further, to, for example, 1 mm, 100 $\mu$m, 10 $\mu$m, or even shorter lengths. In other words, an embodiment of the systems and methods described herein can be implemented as a network of microfluidic arteries, discharge fluid reservoirs, and/or wells—generally known as a microfluidic system or microfluidic network. The network can be formed in an elastomeric substance, in one or more slabs of plastic, or carved onto a stack of waterproof, thin, flexible, elastic film, for example, Parafilm (trademarked by American National Can Company Corporation). An exemplary technique for construction of such a miniaturized network is soft lithography, developed by a team of researchers led by George Whitesides of Harvard University (see, e.g., U.S. Pat. No. 6,645,432 and published U.S. Patent Application No. 20030156992, the entire contents of which are incorporated herein by reference).

In an embodiment, a macromolecule (or another particle, for example) is subjected to a predetermined fluid strain in planar extensional flow, over a desired length of time, thereby producing a deformation or other distortion in the object.

By controlling the movement of the stagnation point 161, the object (not shown) can be moved; by altering the flow pattern or other salient features of the flow, the object can be rotated, subjected to a fluid strain in planar extensional flow (and thereby stretched or aligned along an axis), or held substantially in place, for any desired length of time (to be manipulated and/or studied). With small, smooth variations in a reservoir's altitude, or adjustments of a valve's position, aperture, or a combination of these and other parameters, reproducible stagnation-point localization and movement control can be achieved, with a resolution down to the micron scale possible.

The systems and methods described herein provide a means to observe and manipulate (move, rotate, stretch, align, etc.) an object (e.g., a particle, a macromolecule such as DNA or a cell, or another small particulate) for an indefinite length of time in a device without a moving part, optical trap, micropipette, or other tethering mechanism.

Moreover, the environmental conditions to which the object is exposed may be altered easily. It is possible to trap a particle of any size, given an effective means of detecting it, tracking it, or in some other way observing it. For example, if the average dimension of the particle is between approximately 200 nanometers and 1 millimeter, optical microscopy for imaging may be used. Of course, as already mentioned, the size of the systems according to the invention can be scaled up to study and trap a larger object, such as a millimeter-size cell or drop.

Figure 2A:
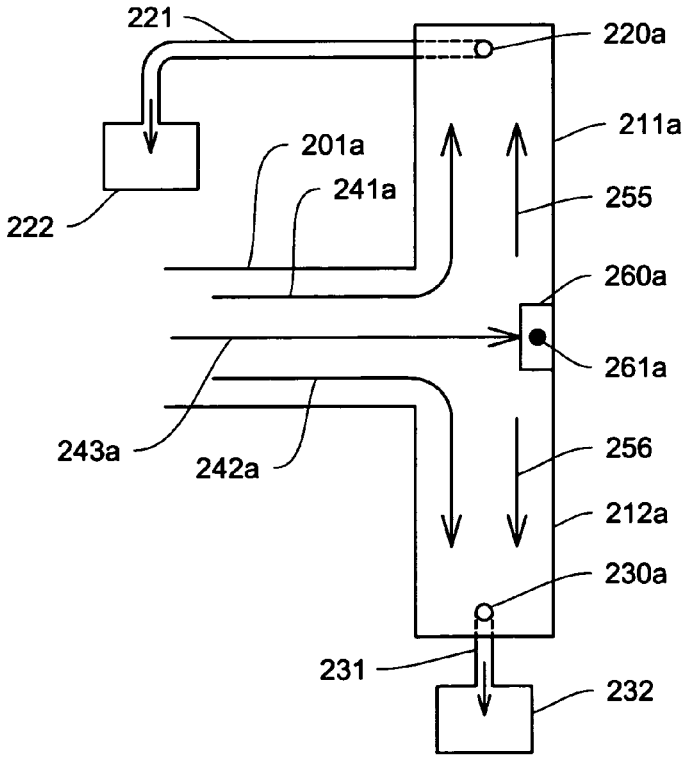
FIGS. 2A–2C depicts exemplary embodiments of the flow stagnation device having a T-junction, arrowhead, and arrowtail architectures, respectively.

FIG. 2A depicts one embodiment of the systems and methods described herein. In this embodiment, the network of flow paths has a T-junction topology having one inlet 201*a* and two outlets 211*a* and 212*a*. The inlet 201*a* carries fluid toward a study region 260*a* and a stagnation point 261*a*. The outlets 211*a* and 212*a* are disposed to carry fluid along substantially opposing directions 255 and 256, respectively, away from the study region. 260*a* and the stagnation point 261*a*. Although the embodiment of FIG. 2A depicts a T-network of flow paths, one of ordinary skill in the art would know that the outlet 211*a* or the outlet 212*a* need not be disposed substantially at a 90-degree angle relative to the inlet 201*a*; the set of alternative fluid flow network topologies would include, for example, a network having an arrowhead shape (FIG. 2B) or an arrowtail shape (FIG. 2C).

Exemplary fluid flow trajectories 241*a*, 242*a*, and 243*a* produced in the T-network embodiment of FIG. 2A are shown in the figure. Fluid carried by the inlet 201*a* splits and enters the two outlets 211*a* and 212*a*, eventually departing from optional exit ports 220*a* and 230*a*, respectively, to fluid receivers 222 and 232, respectively. In an embodiment depicted by FIG. 2A, the fluid receivers 222 and 232 receive fluid carried by optional fluid exit paths 221 and 231, respectively, interfacing with the outlets 211*a* and 212*a*, respectively, via the exit ports 220*a* and 230*a*, respectively. Each of exit the paths 221 and 231 can include an artery, wherein the artery is as defined previously.

By adjusting the motion of the fluid carried by the inlet 201*a* and the outlets 211*a* and 212*a*, the stagnation point 261*a* can be positioned at the boundary of, or superposed on, the study region 260*a*. The flow trajectory 243*a* exemplifies a path of fluid travel incident on the study area 260*a* and/or the stagnation point 261*a*. It is understood by one of ordinary skill in the art to which the systems and methods described herein pertain that a fluid receiver 222 or 223 may be interfaced directly to a respective outlet 211*a* or 212*a*, and may optionally include a respective exit port 220*a* or 230*a* at a respective interface with an outlet 211*a* or 212*a*.

Figure 2B:
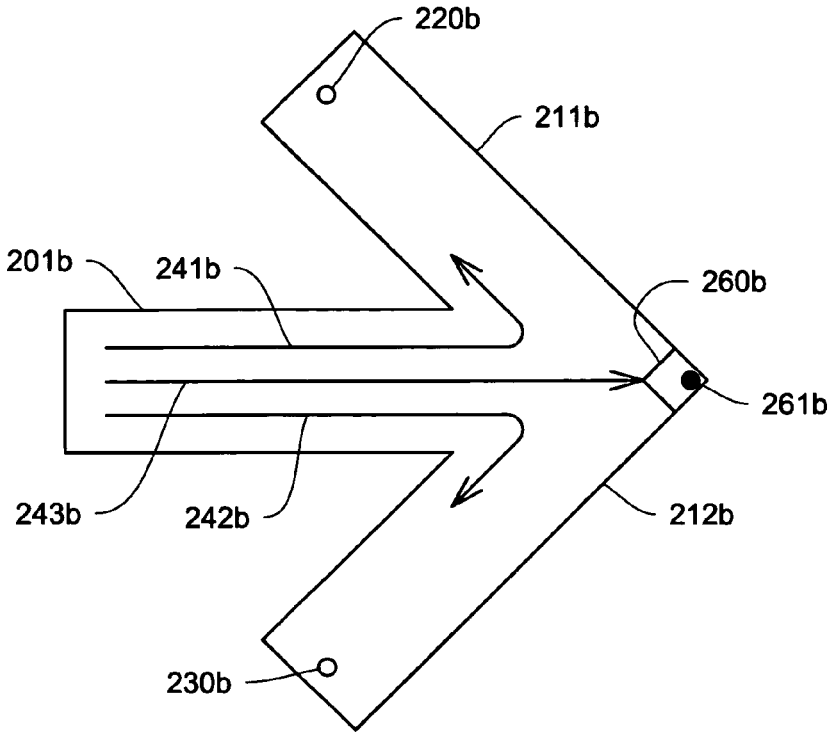
Figure 2C:
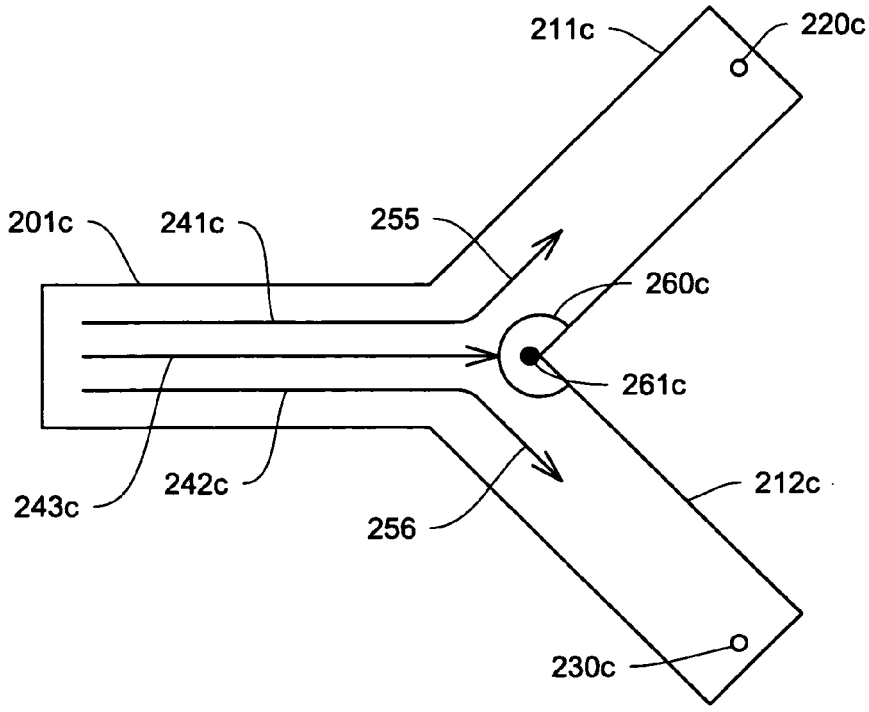

In the alternative arrowhead topology of FIG. 2B and arrowtail topology of FIG. 2C, the outlets are denoted by the head paths (211*b*, 212*b*) and tail paths (211*c*, 212*c*), respectively; the inlet is denoted by the arrow axis (201*b*, 201*c*). The study region is denoted by 260*b*, 260*c*, associated with a corresponding representative stagnation point 261*b*, 261*c*, respectively. Sample flow paths 241*b*, 241*c*, 242*b*, 242*c*, 243*b*, and 243*c*, analogous to those shown and described in relation to FIG. 2A, are depicted in FIGS. 2B and 2C, respectively. Other elements of the embodiment, such as fluid receivers and exit paths, already described for FIG. 2A, are not shown in FIGS. 2B and 2C, but are understood to be within the scope of FIGS. 2B and 2C in an analogous fashion.

Figure 3:
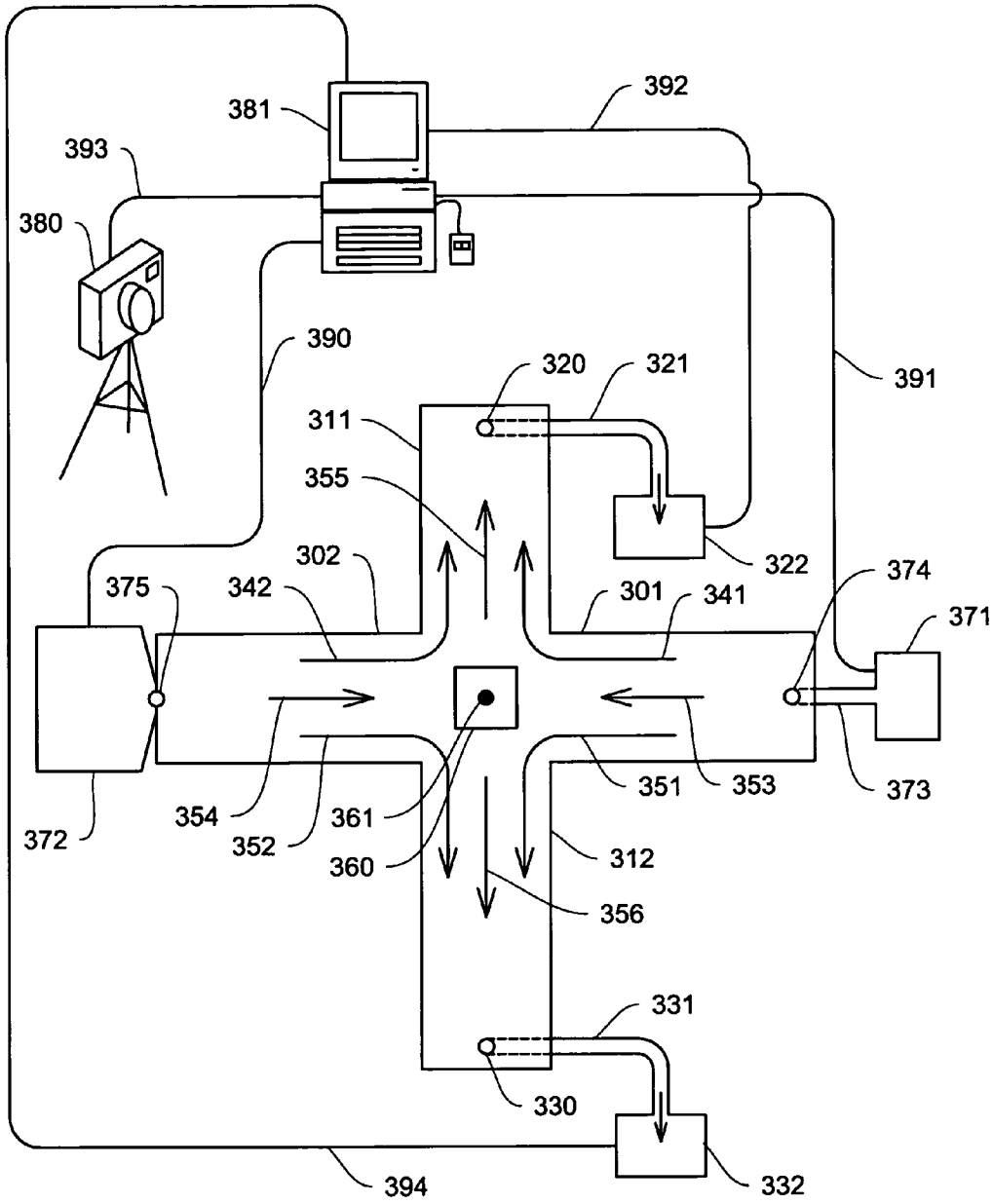
FIG. 3 depicts an exemplary embodiment of the flow stagnation device having a cross-shaped architecture, a sensing device, a computer controller, supply and discharge stations, and other features.

FIG. 3 depicts an alternate embodiment of the systems and methods described herein. In this embodiment, the network of fluid flow paths has a cross-shaped topology having two inlets 301, 302 and two outlets 311, 312. The inlets 301 and 302 are disposed to carry fluid along substantially opposing directions (flow trajectories) 353 and 354, respectively, toward a study region 360 and a stagnation point 361; the outlets 311 and 312 are disposed to carry fluid along substantially opposing directions (flow trajectories) 355 and 356, respectively, away from the study region 360 and the stagnation point 361. According to an embodiment depicted by FIG. 3, an inlet is disposed substantially orthogonally to an outlet.

Exemplary fluid flow trajectories 341, 342, 351, 352, 353, and 354 produced in the cross-shaped network embodiment of FIG. 3 are shown in the figure. Fluid carried by an inlet 301 or 302 splits and enters the two outlets 311 and 312, eventually departing from optional exit ports 320 and 330, respectively, to fluid receivers 322 and 332, respectively. In an embodiment depicted by FIG. 3, the fluid receivers 322 and 332 receive fluid carried by optional fluid exit paths 321 and 331, respectively, interfacing with the outlets 311 and 312, respectively, via exit ports 320 and 330, respectively. Each of the exit paths 321 and 331 is a fluid flow path in its own right, and may include an artery for carrying a fluid, wherein the artery is as defined previously.

By adjusting the motion of the fluid carried by at least a subset of the inlets 301 and 302, and the outlets 311 and 312, the stagnation point 361 can be positioned at the boundary of, or superposed at least partially on, the study region 360. In an embodiment depicted by FIG. 3, for example, controlling the flow resistance in the outlets 311 and 312 can cause the stagnation point 361 to drift along a line (not shown) connecting the outlet ports 320 and 330. In this manner, a sample object (not shown in the figure) introduced to the study region, or already residing in the study region, can be confined to the region by maintaining the stagnation point substantially on or about that region; the object may drift in accordance with the movement of the stagnation point 361. The flow trajectories 353 and 354 exemplify paths of fluid travel incident on the study region 360 and/or the stagnation point 361.

It is understood by one of ordinary skill in the art to which the systems and methods described herein pertain that a fluid receiver 322 or 332 may be interfaced directly to a respective outlet 311 or 312, and may optionally include a respective exit port 320 or 330 at a respective interface with an outlet 311 or 312. One way that fluid motion in an outlet can be adjusted is by varying the resistance upon the fluid attempting to exit the outlet. This can be accomplished by disposing an optional valve at one or both of the exit ports 320 and 330 or along one or both of the fluid flow exit paths 321 and 331; the extent (spatially and/or temporally) of the valve's opening or closing (described, for example, by the position of the valve) can control the rate of fluid exiting the corresponding outlet; this is due, for example, to additional frictional losses that are introduced by a constriction. Valve motion influences the bias of fluid splitting into the two outlets 311 and 312, thereby altering the flow dynamics and pattern, which in turn alter the extensional flow forces acting on the object that is to be trapped on, or within, the study region. One or both the fluid receivers 322 and 332 may include a valve controller to adjust the duration and amount of the valve's opening or closing. In an embodiment, at least one of the fluid receivers 322 and 332 includes a suction device (not shown) to draw the fluid from the respective outlet 311 or 312. The suction device can be mechanical (e.g., a syringe, a mechanical pump, etc.) or electromechanical (e.g., an electromechanical pump). In an embodiment, at least one of the flow receivers 322 and 332 is fluidically connected to the respective inlet 301 or 302, and is disposed to reintroduce to the network the fluid departing from the outlet 311 or 312, thereby recirculating the fluid to be reused. In an alternative embodiment, one fluid receiver, for example 322, is fluidically connected to both the outlets 311; that is, fluid from both of the outlets 311 and 312 is discharged onto one fluid receiver, 322. In this embodiment, the resistance to fluid flow in each of the outlets 311 and 312 may be adjusted by, for example, by positions and/or motions of the valves 320 and 330, and not by the differential altitude adjustment of two reservoirs described below in relation to FIG. 3, as there are no two fluid receivers whose relative altitudes could be adjusted, in this embodiment.

In one embodiment depicted by FIG. 3, a flow path belonging to the cross-shaped flow network stagnation device includes a standard 1 inch by 3 inch microscope slide (substantially 1 mm thick) with optional holes to allow for flow connections (to facilitate fluid flow into the inlets 301 and 302, and out of the outlets 311 and 312). A hole in an outlet can serve as an exit port 320 or 330. An optional hole in an inlet 301 or 302 can serve as a fluid/object entry port, e.g., 374 and 375.

The walls of the flow chamber may be formed by a stack of Parafilm carved according to the shape of the cross-shaped topology depicted by FIG. 3. In this manner, a cross pattern is cut into a stack made of a variable number of thin sheets of Parafilm; the resulting wax pattern is used as a spacer between the slide and a microscope cover slip, together defining a cross-shaped fluid flow network. A typical width of a flow path 301, 302, 311, 312, 321, or 331 may range from 5 mm to 10 mm, though it need not be restricted to these values, and may be one or more orders of magnitude smaller or larger, depending on the application in which a device according to the invention is being employed and/or the size of the object to be stagnated; a typical depth of a flow path may range from about 60 microns to about 1000 microns, though, again, it need not be restricted to these values, and may be one or more orders of magnitude smaller or larger. In a typical application, however, a flow path is far wider than it is deep; the width/depth ratio was described earlier by the r/d ratio, where r denotes the width of the channel and d the depth. These widths and depths would generally be consistent with the dimensions of the optional exit ports 320 and 330 and the optional entry ports 374 and 375. The stagnation flow device can be seated and affixed onto a holder, and one or more of the optional exit paths 321 and 331 (such as a micro-bore flow line having a 1/16 inch inner diameter) may be appended to a surface (e.g., the underside facet) of the microscope slide.

FIG. 3 depicts two supply stations 371 and 372. One or more of the exit paths 321 and 331 may be submerged in, and in fluidic communication with, the respective fluid receiver 322 or 332. A receiver may include a discharge fluid reservoir used as a waste container for fluid exiting an outlet. In one embodiment, the fluid motion is adjusted by varying the altitude of a first discharge fluid reservoir (e.g., 322) relative to the altitude of a second discharge fluid reservoir (e.g., 332). For example, the first discharge fluid reservoir may be held at a fixed altitude, whereas the altitude of the second discharge fluid reservoir is varied, preferably smoothly. In this manner, a flow bias is created between the outlets 311 and 312, due, at least in part, to a fluid pressure differential, causing the stagnation point 361 to be positioned in accordance with the adjusted fluid flow. As the stagnation point 361 moves, so, too, does the object under study. By maintaining the stagnation point 361 proximal to the study region 360, the object can be confined substantially to the study region 360.

The fluid motion may be adjusted in other ways as well. For example, in an embodiment, the supply station 371 or 372 can include a pump to inject fluid to the respective inlet 301 or 302. The supply station may include a syringe used to inject the sample object and/or the fluid to the flow network. The pump may be a mechanical pump or an electromechanical pump. In an embodiment, a supply station (e.g., 372) is directly fluidically connected to a respective inlet (e.g., 302); for example, the supply station may be disposed to be flush with a wall of the inlet. Alternatively, and optionally, a supply station (e.g., 371) can be fluidically linked, by a fluid entry path (e.g., 373), to a respective inlet (e.g., 301). The fluid entry path 373 is a fluid flow path in its own right, and may include an artery for carrying a fluid, wherein the artery is as defined previously.

A cross-shaped fluid flow network for confining the object within a study region can be constructed by first drilling 4 holes through quartz microscope slides (1 inch×3 inch×1 millimeter); this can be done using a diamond-tipped bit. A quartz surface can be cleaned in, say, a 1:1:1 solution of hydrogen peroxide, water, and hydrochloric acid, followed by sonication in 1M potassium hydroxide, followed by vigorous rinsing with water. A cross pattern can be formed (for example, by carving/cutting) into a stack of Parafilm sheets placed between the quartz slide and a glass cover slip. The flow device (including the quartz slide, the Parafilm stack, and the glass cover slip) is gently heated to melt the wax, and subsequently cooled to seal the flow paths. Finally, the flow network stagnation device can be mounted onto a microscope stage, and micro-bore flow lines seated against, and affixed to, the underside of the stagnation device. The device described above may optionally be modified to provide flexibility in the type of sample object being investigated, as is subsequently explained herein. In an embodiment, planar extensional flow can be created by a cross-shaped stagnation device with a typical inlet/outlet depth of approximately 150 $\mu$m and width of approximately 7 mm (corresponding to a r/d ratio of about 47). Feedback control may be used to stagnate the object by varying the altitude of one fluid receiver (e.g., 322) relative to a fixed fluid receiver (e.g., 332). In an exemplary embodiment, the study region 360 may include an area of approximately 480 square micrometers.

In one embodiment, fluids having different properties (e.g., viscosity) may be used to create an extensional flow, e.g., along the directions (flow trajectories) 355 and 356, such that the speed of movement of the object trapped on, or within, the study region can be controlled; alternatively, the extensional flow can be used to manipulate the object mechanically, for example, by stretching the object along directions substantially aligned with the flow trajectories 355 and 356.

In one embodiment, the device may be adapted for use with a high-viscosity fluid (greater than approximately 100 cP). In an alternative embodiment, the fluid may have a viscosity as low as that of water (1 cP). Since the variation in vertical height of one discharge fluid reservoir may not provide a large enough resistance variation for efficient or effective stagnation point control, a valve can be included, say at the exit port 320, controlling fluid discharge from a respective outlet 311. The resistance to the fluid flow can then be controlled by altering the valve position, and modulating the length of time that the valve is held at any position as a function of time. The valve motion introduces constriction variations that result in changing frictional forces acting on the fluid attempting to exit an outlet.

In the embodiment depicted by FIG. 3, a feedback control mechanism is shown, including a computer 381 a sensing device 380, and exemplary communication links 390, 391, 392, 393, and 394 facilitating interaction among the computer 381, the sensing device 380, and the stagnation flow network. The link 393 facilitates a uni- or bi-directional communication and/or control between the computer 381 and sensing device 380. If the computer 381 receives a data signal from the sensing device 380 (for example, as part of monitoring the data collected by the sensing device), but does not issue a control signal to the sensing device, the link 393 is unidirectional. However, if the computer 381 not only receives a data signal from the sensing device 380, but also sends a control signal to the sensing device (to control the operation of the sensing device, e.g., if the sensing device includes an imaging device, adjust an imaging setting, camera position, etc.), the link 393 is bi-directional. Each of the links 390, 391, 392, and 394 may similarly be uni- or bi-directional, depending on whether communication between the computer 381 and a subset of the supply stations 371, 372, and the fluid receiver 322 is two-way or one-way. In one embodiment, the links 392 and 394 carry information about the altitude of the discharge reservoirs at the fluid receivers 322 and 332, respectively, to the computer 381. According to one particular practice, the computer 381 issues one or more controls, via the links 392 and 394, respectively, to adjust the altitude of the reservoirs at the fluid receivers 322 and 332, respectively. The commands issued by the computer 381 to the fluid receivers 322 and 332 may be based, at least in part, on one or more parameters associated with the fluid flow in at least a portion of the stagnation flow network, such as, without limitation, the flow pattern in a neighborhood of the stagnation point, a pressure differential in the outlets 311 and 312, etc.

Although in FIG. 3 the communication links are shown as hard wires, it should be apparent to one of ordinary skill in the art that the computer 381 may be operatively connected to, and/or interacting with, a subset of the sensing device 380, the supply stations 371 and 372, and the fluid receivers 322 and 332 wirelessly. Furthermore, it is not necessary that there exist a communication link between the computer 381 and every element in FIG. 3 belonging to the object confinement device. One or more communication links to at least a subset of the supply stations 371 and 372, the fluid receivers 322 and 332, and the sensing device 380 would suffice to establish feedback control of the operation of the flow stagnation device according to FIG. 3.

In an embodiment, the flow stagnation device may be controlled by the computer 381 to automate the operation of the device. For example, the computer can be used to automate the operation or settings of a subset of the fluid receivers 322 and 332, the feedback control mechanism, and/or the acquisition, storage, or analysis of data obtained by the sensing device 380 or any other optional data acquisition device that may be employed by the feedback control mechanism. An example of a data acquisition device would be a sensor (not shown in FIG. 3) disposed at a predetermined location along an inner wall of a fluid path (the inlets 301,302, and/or the outlets 311, 312). The sensor may communicate wirelessly or via a wired link with the computer 381. The sensor may be designed to measure a characteristic of the moving fluid (e.g., pressure, viscosity, acidity, chemical content, presence of a biological agent, etc.). Alternatively, the sensor may be designed to detect and track the motion of the object that is to be trapped in the study region 360. The sensor sends data to the computer 381, which in turn processes information content associated with the data, and issues a control signal. The control signal includes one or more instructions to the sensor, or to another controllable element (e.g., a fluid receiver, a supply station, etc.) in the stagnation network device. In an embodiment, a sensor may be disposed at one or more of: the supply stations 371 and 372, and the fluid receivers 322 and 332. For example, a sensor disposed at a fluid receiver can measure the amount of fluid stored in the discharge reservoir associated with the receiver, the rate at which the fluid enters the station, the altitude of the reservoir (if the altitude is relevant in the embodiment), or a combination of these and other features.

It is possible to equip the computer 381 to interact with the sensing device 380, to instruct the sensing device to monitor and record activity of the object on or in proximity to the study region 360. For example, in an embodiment wherein the sensing device includes an imaging device such as a camera, it is possible to couple an image analyzer (possibly in the form of software or firmware acting on the imaging device) and the computer 381 to compute the location of the trapped object in real time. As the object drifts preferentially to one outlet direction, the flow could be automatically adjusted to move the object's center of mass back to the study region 360 constituting the image area of interest.

In yet another embodiment, the flow stagnation device can be used to investigate an extension-dominated two-dimensional planar flow. For example, by changing the angles of intersection of the cross-shaped flow path architecture, it is possible to create a flow of differing extension and rotation characteristics. The stagnation point can be controlled using feedback.

Figure 4:
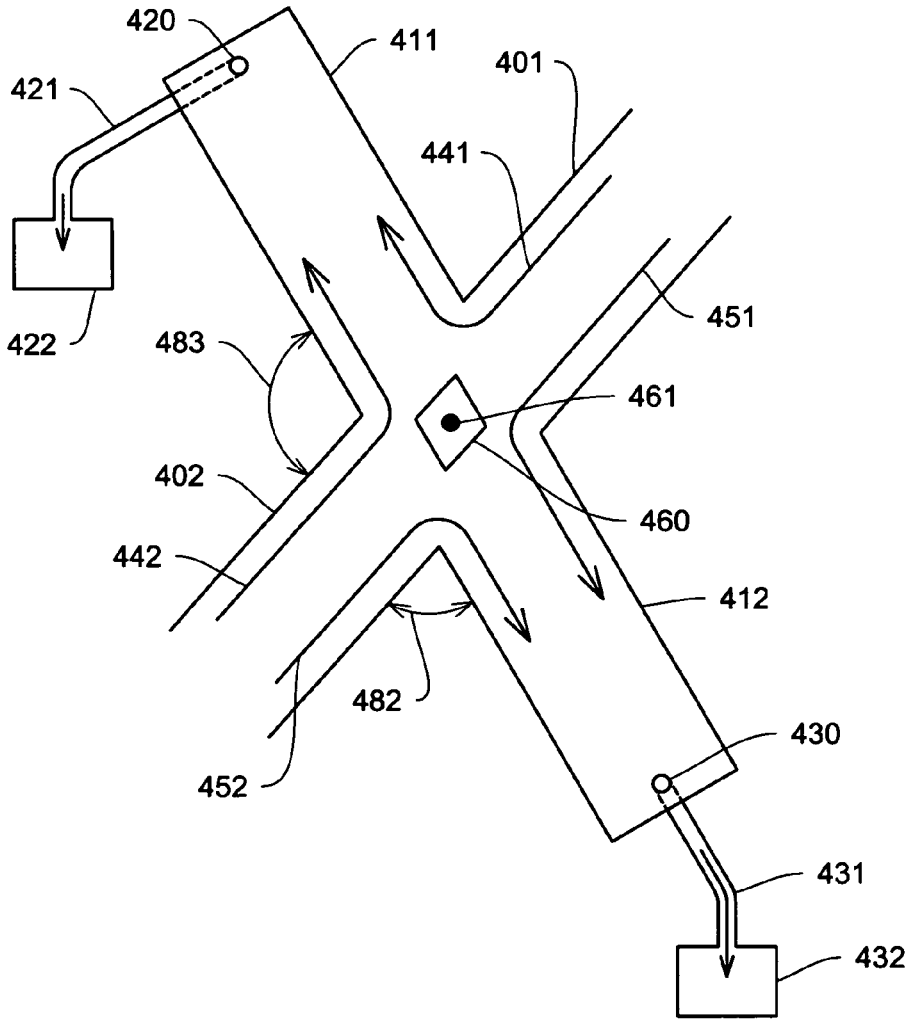
FIG. 4 depicts an exemplary embodiment of the flow stagnation device having an X-shaped architecture, wherein inlets and outlets form substantially acute or obtuse angles relative to each other.

FIG. 4 depicts an embodiment according to the systems and methods described herein, wherein the flow network has an X-shape topology. In contrast to the cross-shape topology of FIG. 3, an inlet-outlet angle 482 or 483 need not be substantially 90 degrees. Rather, the angle can be acute (as depicted by 482) or obtuse (as depicted by 483). FIG. 4 shows exemplary fluid flow trajectories 441, 442 and 451, 456, carried along the inlets 401, 402 and the outlets 411, 412. By controlling the fluid entering the inlets 401, 402 and the fluid exiting the outlets 411, 412, it is possible to control the position of the stagnation point 461 to ensure that it is on, or at least proximal to, the study region 460.

Figure 5:
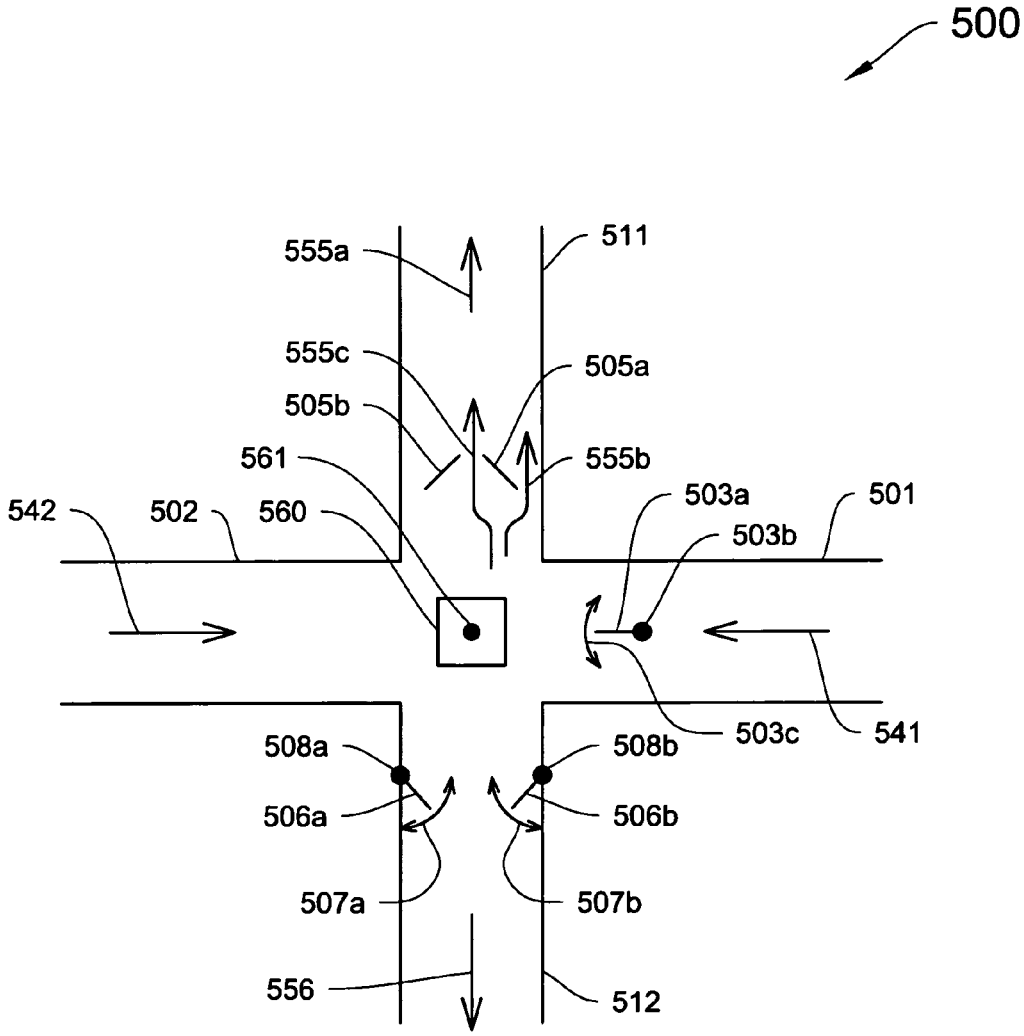
FIG. 5 depicts an exemplary embodiment of the flow stagnation device having a cross-shaped architecture and depicting flow deflectors to produce desired flow patterns.

The systems and methods described herein may include one or more flow deflectors on or between the walls of an inlet, an outlet, or both, guiding fluid flow to produce a desired flow pattern. An exemplary embodiment 500 is shown in FIG. 5. Depicted by the figure are inlets 501 and 502, fluidically connected with outlets 511 and 512 according to a cross-shaped pattern architecture similar to the embodiment shown in FIG. 3. Exemplary paths of fluid flow are depicted by 541 and 542 (directed toward the study region 560 and the stagnation point 561) and 555*a*–555*c* and 556 (directed away from the study region and the stagnation point). FIG. 5 depicts a variety of flow deflectors that may be employed by an exemplary embodiment of the systems and methods described herein.

For example, a flow deflector may be stationary, such as is depicted by either of 505*a* and 505*b*. A stationary deflector may be disposed at an orientation that may be selected a priori to produce a desired flow pattern. Examples of stationary flow deflectors include one or more grooves or indentations formed on a wall, including a basin, of an inlet or outlet, a projection fixedly attached to a wall of an inlet or an outlet or disposed elsewhere along an inlet or outlet or at an intersection of one or more inlets and outlets, or a combination of these.

Alternatively, a flow deflector may be movable, such as that shown by any of 503*a* and 506*a–b*. A movable flow deflector may include a flap (506*a* or 506*b*) hingedly supported at a wall of a flow channel (e.g., the outlet 512). A flap, such as 506*a* or 506*b*, may pivot about a respective hinge 508*a* or 508*b*, tracing a respective exemplary substantially rotational motion trajectory 507*a* or 507*b*. Alternatively, an embodiment according to the systems and methods described herein may include an inlet wall or an outlet wall having at a least a portion that is made of flexible material. By flexing the flexible portion, a flow deflector can be created, altering the flow pattern. In yet another embodiment, a movable flow deflector may retract inside a wall of an inlet or an outlet, or it may protrude from it, perhaps in a time-dependent fashion, as desired, or according to commands issued by a computer controller (not shown in FIG. 4, but similar to the computer controller of FIG. 3).

Those of ordinary skill in the art would know that a movable flow deflector may be controlled in a variety of ways, e.g., by a combination of any subset of pneumatic actuation, magnetic actuation, electromechanical actuation, electromagnetic actuation, etc. For example, a solenoid actuator may be employed to cause the flow deflector to move. In an exemplary embodiment, the motion of a flow deflector may be governed by a controller (not shown in FIG. 5). The controller may receive data from a feedback mechanism (not shown in FIG. 5), and in turn cause a flow deflector to move according to a set of one or more control rules or instructions.

A flow channel, such as an inlet, may contain no flow deflector (e.g., 502), one flow deflector (e.g., the inlet 501 includes the movable flow deflector 503*a* pivoting about a hinge 503*b*), or more than one deflector (e.g., the outlet 512 includes two deflectors 506*a–b*). Those of ordinary skill in the art, e.g., the art of fluid dynamics, having read this disclosure, would be able to devise equivalents to the embodiments suggested by, or inferred from, FIG. 5, and can design exemplary embodiments analogous to those disclosed herein, including embodiments that encourage laminar fluid flow or turbulent fluid flow.

It should be understood that the systems and methods described herein may include a variety of embodiments having fluidically connected flow paths (inlets and outlets), and are not limited to the embodiments depicted by FIGS. 2–5; for example, a flow network configuration may include a set of five or more inlets and/or outlets. For such configurations, too, a combination of flow control and flow path architecture/topology is important to maintain a stagnation point in a study region of interest, so that an object can be trapped on, or within, the study region. The particular flow network configuration, construction, and methods of use described herein correspond merely to illustrative embodiments, and should not be interpreted in a restrictive sense.

Optionally, the systems and methods described herein may include one or more of a variety of sensing devices deployed to monitor a state or characteristic of the object (e.g., position or motion) or other activity in the study region and/or the vicinity thereof (e.g., a fluid flow characteristic, emissions from the object, e.g., fluorescence, radioactivity, electromagnetic waves, heat light, etc.). The sensing device may be configured to collect data from any subset of the object, the study region, a portion of one or more of the inlets and outlets, etc., and generate an output as a function of the collected data. The generated output can be communicated to a controller to control the fluid flow and stagnate the object or manipulate the object in a desired manner. Alternatively, the generated output can be used to detect and track the object.

A sensing device may include an imaging sensor (e.g., a nuclear magnetic resonance (NMR) sensor, a magnetic resonance imaging (MRI) sensor, a camera, a night vision, color night vision, or other low-light sensitive imaging device, etc.); alternatively, the sensing device may be a radioactive sensor (e.g., a Geiger counter), a sonar sensor, a radar, an acoustic sensor, a thermal emission sensor, a spectrometer (e.g., thermal, electromagnetic, etc.), a positron emission tomography (PET) sensor (or scanner), or any of a variety of sensing devices known to those of ordinary skill in the relevant art to which the systems and methods described herein pertain.

In an embodiment according to the systems and methods described herein, the object may be labeled with a positron-emitting radioisotope (e.g., a positron-emitting radionuclide), and a PET scanner used as a sensing device to detect the presence of the object, track the object, observe the object, or a combination thereof. In one embodiment, an object trapped on or within a study region may be observed by an optical microscope, which may be optionally equipped with a recording device (such as a CCD- or CMOS-based system). Captured image data, measurement data, acquisition, storage, and analysis of the data may be controlled and executed by a computer (e.g., 381 in FIG. 3); the control may be automatic or it may be manually implemented. The computer 381, for example, may be programmed to execute software to monitor and process measurement data obtained from the sensing device (such as the sensing device 380). The monitoring can be in the form of detecting and/or tracking the object in the study region 360. A software or hardware implementation of a commercial or proprietary detection and/or tracking algorithm may be used for this purpose. Any of the variety of sensing devices mentioned earlier may be operatively coupled to a recording device, to a computer, to a software and/or hardware necessary to process data collected by the sensing device.

One embodiment of the invention provides researchers with a tool for indefinite observation time of samples on the microscale. The device, if coupled with an imaging system, allows one to study the behavior of an object (particle, macromolecule, drop, cell, etc.) for extremely long period of times, during which the environmental conditions surrounding the object/sample may be altered. The device provides flexibility regarding the nature of the sample being studied and can be used with various imaging techniques. When applied to rheological studies, the device allows one to subject a macromolecule (or any particle) to indefinite amounts of fluid strain in planar extensional flow.

The device also provides an excellent platform for the stretching and imaging of macromolecules such as DNA, which has direct application in genome sequencing and many other biomedical settings. For example, using a device according to the invention, one can stretch a linear fragment of genomic DNA on which specific base pair sequences have been selectively labeled with one or more fluorescent tags (dyes or markers). Direct observation of the stretched DNA molecules is possible when the invention is coupled to an imaging system. Buderi reported on page 76 in the November 2002 issue of Tech. Review 76 that a "personal DNA sequencer" is being developed, which may eventually finish sequencing an individual's genome in about 45 minutes; the contents of Buderi's article are incorporated herein by reference. The DNA sequencer uses a series of metal pins arranged in a funnel-shaped pattern. DNA molecules (relabeled with nucleotides containing fluorescent dyes specific for one of the four bases) enter the large mouth of the funnel, and are pushed towards the narrow end of the funnel as a result of the rolling motions of the metal pins. The DNA molecules also become stretched during their movement towards the narrow end. Once a labeled individual DNA enters a long tube connected to the exit at the narrow end, the sequence of the DNA molecule can be read out directly by exciting the fluorescent dyes.

A device according to the systems and methods described herein may be used in a similar type of machine to advance the DNA molecules towards the same detection system. One advantage of the systems and methods described herein is that DNA molecules to be sequenced may not need to be pre-labeled by fluorescent dyes before being loaded into the machine. Since a device according to the instant invention can hold the subject DNA molecule at the stagnation point for as long as necessary, labeling can be done in the stagnation flow device by injecting fluorescent dyes (either simultaneously or sequentially) through the inlets. Once the labeling is complete, the DNA molecule can be advanced through one of the exits (such as one equivalent to the fix-height discharge reservoir referred to earlier) for sequencing. This design eliminates the need to transfer labeled DNA to the sequencer, and is thus more amenable for automation and high throughput sequencing. Another potential advantage is that very long DNA molecules (millimeter-size mega base pair molecules) can be sequenced without the potential risk of accidentally breaking long DNA molecules by the rolling pins of Bentley and Leal. The same technology may also be used for directly sequencing RNA molecules, since RNA molecules are naturally single-stranded, and it is not necessary to denature the same before a fluorescent dye-labeled ribonucleotide can hybridize to the template RNA.

The systems and methods described herein can also be used to quickly detect single nucleotide mutations in a patient's DNA sample. Many diseases are either the direct result of a single nucleotide mutation in a critical gene, or associated with a single nucleotide polymorphism (SNP) such that an individual having a particular SNP invariably, or almost certainly, possesses a disease gene. For example, sickle cell anemia, the most common inherited blood disorder in the United States (affecting about 72,000 Americans, or 1 in 500 African Americans), is caused by a single nucleotide missense mutation resulting in the replacement of the wild-type Glutamine (Glu) by a mutant Valine (Val) in the hemoglobin A chain.

In another example, Machado-Joseph disease (MJD), Huntington's disease and at least seven other neurodegenerative disorders all are caused by the same type of genetic mutation. The genetic defect in these diseases produces a mutated protein with an abnormally long stretch of a repeated amino acid. A single nucleotide polymorphism (SNP) occurs just next to the mutated sequence in about 70 percent of mutant MJD genes. Thus, such SNP may be of diagnosis value for MJD or other neurodegenerative diseases.

To detect such kind of single nucleotide mutations, a patient's DNA fragment, which potentially harbors such a mutation, may be hybridized in the flow chamber of the instant invention with a wild-type probe. If the patient's DNA contains a single nucleotide mutation that mismatches the wild-type probe, the image of the hybridization complex can be observed/recorded by the imaging device, thus revealing the presence of the mutation. Since the fluid surrounding the patient's DNA can be quickly changed, all steps, including prehybridization, hybridization, and washing, even carried out in different temperatures, can be done in the same flow chamber.

The location of the mutation can be further defined by, for example, adding a restriction enzyme in its optimal buffer system, so that a section of the patient's DNA can be cut away. Based on the restriction enzyme cutting point, the location of the point mutation may be determined.

In another embodiment, a polynucleotide fragment may be micro-manipulated (such as subjecting to restriction endonuclease digestion in the flow chamber), and the resulting fragment can be isolated for further analysis and/or manipulation, such as PCR or other sequence amplification, or direct sequencing.

The invention is further illustrated by the following examples which should not be construed as limiting.

The systems and methods described herein may be used for analysis in a wide range of technical fields. For example, some embodiments of the systems and methods described herein will be useful in the analysis of biological problems. The examples provided here are merely for illustrative purposes. It is understood that one of ordinary skill in the relevant art, upon review of this document, will perceive additional uses for the disclosed technology.

The ability to confine a biologically relevant object in a flow stagnation region presents a host of opportunities. It will often be advantageous to observe the object under controlled conditions that may be provided by a flow system. Biological materials are often dynamic, chemically active and highly sensitive to conditions such as pH, solute concentrations (e.g., salt concentration, nutrient concentration), temperature and oxidation; therefore, it will be highly desirable to use aspects of the present disclosure to maintain a biologically relevant object in a steady state condition for observation. Observation may include, for example, optical measurements, such as absorption and emission spectra (e.g., absorption spectroscopy, fluorescence analysis), microscopy, circular dichroism, birefringence analysis, and light scattering. Observation may also include, for example, measurement of substances in the influx and efflux flow stream. The consumption or production of substances by an object such as a cell may be highly informative.

In addition to facilitating the steady state observation of biologically relevant objects, some embodiments of the systems and methods described herein are also amenable to use in an experimental manipulation and testing of a confined biologically relevant object. For example, an object held in a flow stagnation region may be exposed to one or more differing conditions by altering the composition of the influx flow stream. General parameters such as pH, temperature, reactant concentration, reactant temperature, and nutrient supply may be altered. In one embodiment, the temperature is adjusted by a heater coupled to one or more of the flow paths, altering the fluid temperature exposed to the heater. The heater may effect a temperature variation on the object, the fluid in a flow path, or on the flow path itself, by convection, conduction, radiation (including, for example, microwave radiation), or a combination of these.

In one embodiment, the heater may be disposed on an outside surface of a flow path. In an alternative embodiment, the heater may be disposed on an inside surface or portion of a flow path, heating the fluid that flows in an area substantially adjacent to the heater. Specific agents may be introduced, such as selective agonists or antagonists, binding agents (e.g., antibodies), proteins or other substances that may cause an observable change in the trapped object.

Given the diversity of objects that may be confined using systems and methods described herein, the phrase "biologically relevant object" is used to indicate any of the various objects that may be confined for purposes related to the life sciences. Many biologically relevant objects comprise one or more biomolecules. The term "biomolecule" is intended to encompass any molecule, or fragment thereof, that is part of a class of molecules that occur within or are produced by, a living organism. A biomolecule may be produced synthetically. Common classes of biomolecules include nucleic acids (and artificial analogs thereof), polypeptides (and peptidomimetics), lipids, polysaccharides, monosaccharides, amino acids, nucleotides (as well as nucleosides, purines and pyrimidines), flavonoids and isoprenoids. A biologically relevant object may be a biomolecular assembly, meaning an aggregation, ordered or disordered, of associated molecules comprising at least one biomolecule. A biologically relevant object may include one or more macromolecules, which are generally molecules (biomolecules or otherwise) having a molecular weight greater than 500 or 1000 daltons.

Cells may be used in, or by, the systems and methods described herein, including living cells, dead cells, prokaryotic cells, eukaryotic cells, or any combination of these. Where a cell is too small to effectively confine, a plurality of attached cells may be analyzed. Cells may be adhered to a matrix or other surface. Cellular organelles may also be suitable for analysis, including mitochondria, chloroplasts and nuclei. As an example, an embodiment of the systems and methods described herein may be used to confine a cultured cell, such as a fibroblast, for observing and/or exposing the cell to one or more stimuli. Cells may be observed to record any responses to stimuli. Examples of stimuli include growth factors, hormones, neurotransmitters, gases, such as nitric oxide, oxygen and cabon dioxide, other cells, including pathogenic cells or viruses. Observations may include microscopic examination of cellular morphology. The cell may include fluorescent reporter genes or other marked components that are readily observed by any of a variety of techniques. A cell may be loaded with a dye that responds to stimuli, such as pH sensitive or ion sensitive dyes. Tissue samples and small multicellular organisms may also be analyzed, as well as cultured multicellular assemblages.

A biologically relevant object may include a lipid assembly. A lipid assembly may be, for example, a monolayer, bilayer or higher-order structure, arranged in sheets, tubes or closed (e.g. spherical) surfaces and the like. These may be vesicles, liposomes, micelles (including, for example, surfactant micelles), etc. The precise geometry adopted by an assemblage of lipids will often be dynamic, depending on conditions such as temperature, solvent polarity, salt concentration, lipid oxidation, and the types of lipids included (e.g., polar, positively or negatively charged, saturated, unsaturated, sterol). Often, one or more proteins will be incorporated in the lipid assembly, such as integral membrane proteins and membrane associated proteins. Naturally occurring liposomes that may be analyzed include the various lipoprotein complexes of the blood, including LDLs and HDLs. Vesicles comprising integral membrane proteins, such as ion channels or receptors, may be used. Vesicles may be loaded with dyes, solutes, or whatever else may be desired. As a specific example, one may generate vesicles loaded with a lipid-insoluble calcium-sensitive dye and including a calcium channel in the membrane. The vesicles may be confined and exposed to various conditions while a readout of fluorescence is used to determine a relationship between changes in conditions and changes in calcium transport. Other lipid structures include vesicles obtained from cells, such as vesicles derived from the endoplasmic reticulum, the Golgi apparatus, the lysosome or caveolae. Cell ghosts, such as reticulocyte ghosts may be used.

Biologically relevant objects may be primarily protein based, including, for example, ribosomes (which also contain significant nucleic acid), inclusion bodies, flagellae, pili or other extracellular protrusions, spliceosomes, proteasomes, centrioles (or other microtubule organizing centers), myofibrils, as well as protein:nucleic acid complexes. Protein:nucleic acid complexes include generally any composition of protein:DNA, protein:RNA or protein and another type of nucleic acid or nucleic acid analog. Examples include DNA or RNA polymerase complexes, spliceosomes, chi structures, origins of replication with associated proteins, and chromosome or plasmid partitioning complexes.

Another category of a biologically relevant object is a virus or viral particle. Viral particles may be inactive or disabled in some way. The viral particle may be a capsid only, without the encapsulated nucleic acids.

Nucleic acids may be large enough to be confined using systems and methods described herein, or formed into an assemblage of appropriate size. This permits the real-time analysis of changes in nucleic acid conformation in differing conditions. For example, a DNA molecule may be exposed to any of a variety of DNA binding proteins or enzymes, including, for example, a recombinase, a nuclease (e.g., endo- or exonuclease), a ligase, a polymerase, a methylase or other DNA modifying enzyme, a transcription factor (e.g., sigma factor, enhancer, TATA binding protein, repressor), a histone, a clamp such as PCNA, or a kinetochore protein, such as a motor protein. A nucleic acid may also be exposed to various chemical agents, such as mutagens generally, including intercalators and alkylating agents. Suspected mutagens or carcinogenic substances may also be used, and the effects on the nucleic acid evaluated. In certain embodiments, one or both ends of a nucleic acid will be affixed to a bead or other marker to facilitate observation. A variety of phenomena associated with nucleic acids may be monitored, including, as examples, response to endonuclease or exonuclease digestion, hybridization (including, in an embodiment, using a device according to the invention to increase a hybridization rate), denaturation, renaturation, exposure to mutagens or carcinogens, transcription, hairpin or other secondary and tertiary structure formation, exposure to any of various DNA or RNA binding or processing proteins, exposure to different ionic concentrations or types.

While the preceding examples of biologically relevant objects has tended to focus on particles in the size range of hundreds of nanometers to microns, smaller entities may also be analyzed by attaching these to form assemblages of appropriate size. For example, entities, such as proteins or short nucleic acids may be adhered, covalently or non-covalently, to beads or other macromolecular structures, including cyclodextrins, polyvinylpyrrolidones, gelatinous matrices (e.g., polydextrans, polyacrylamides, agarose), lipid assemblies, cells, collagen matrices or other proteinaceous aggregates. Beads or macromolecular structures carrying magnetic particles may be used. The overall biomolecular assembly may then be introduced into a flow system as described herein and the attached entities analyzed.

A biologically relevant object may include some type of marker to facilitate observation. A marker may be, for example, a fluorescent compound or protein, and often the fluorophore will be responsive to certain conditions, such as ion concentrations. So-called "quantum dots" are an increasingly usable type of fluorescent marker, available, for example, from Quantum Dot Corp. (Hayward, Calif.). A marker may also be radiological, such as a radioisotope or a marker with a signature in nuclear magnetic resonance, such as an Fe(II), Fe(III) or technetium containing marker. A marker may also have sonic properties or other chemical properties (e.g., an enzyme that generates a chemiluminescent product) that facilitate detection. Markers may be incorporated into or attached to the object in advance, or markers may be introduced by addition to the influx flow stream.

For those embodiments that involve exposing the biologically relevant object to two or more conditions, a variety of reagents may be employed. For example, an object comprising proteins may be exposed to antibodies that bind the protein, ligands, cofactors, substrates, products, known or suspected agonists or antagonists, regulatory proteins (e.g. kinases, ubiquitin ligases), protein binding partners, nucleic acid or carbohydrate binding partners (or suspected binding partners). For nucleic acids, as described above, it may be desirable to add any of the various DNA or RNA binding proteins or chemical agents that affect the nucleic acid. It may be desirable to add denaturing agents (both for proteins and nucleic acids, selected accordingly), such as urea, guanidinium, chaotropic salts or detergents. It may be desirable to add oxidizing or reducing agents. For example, changes in the behavior of a lipid assembly may be monitored under conditions of increasing oxidation. As another example, the effect of a reductant such as a dithiothreitol on protein dynamics may be monitored. As another specific example, the polymerization and depolymerization of proteins such as tubulin and actin may be monitored in differing conditions. Possible additives include nucleotides (especially ATP for actin and GTP for microtubules), microtubule or actin associated proteins, nucleating factors, cleaving factors (e.g. gelsolin) and capping proteins.

Manipulations need not be performed solely through the influx flow. Biomolecules are often sensitive to features such as temperature, electrical and magnetic fields and vibration that can readily be applied to the system without altering the composition of the inflowing material.

Observations of Polymer Configuration Hysteresis in Extensional Flow

A flexible polymer molecule in a fluid flow typically exhibits one of two states: an equilibrium coiled state and a stretched state. A flowing fluid influences a flexible polymer's configuration in a solution. In general, a flow with a large rotational component tends to not perturb the polymer's configuration far from the equilibrium coiled state. However, a flow with a dominant extensional component may substantially orient and stretch the flexible polymer.

Figure 6:
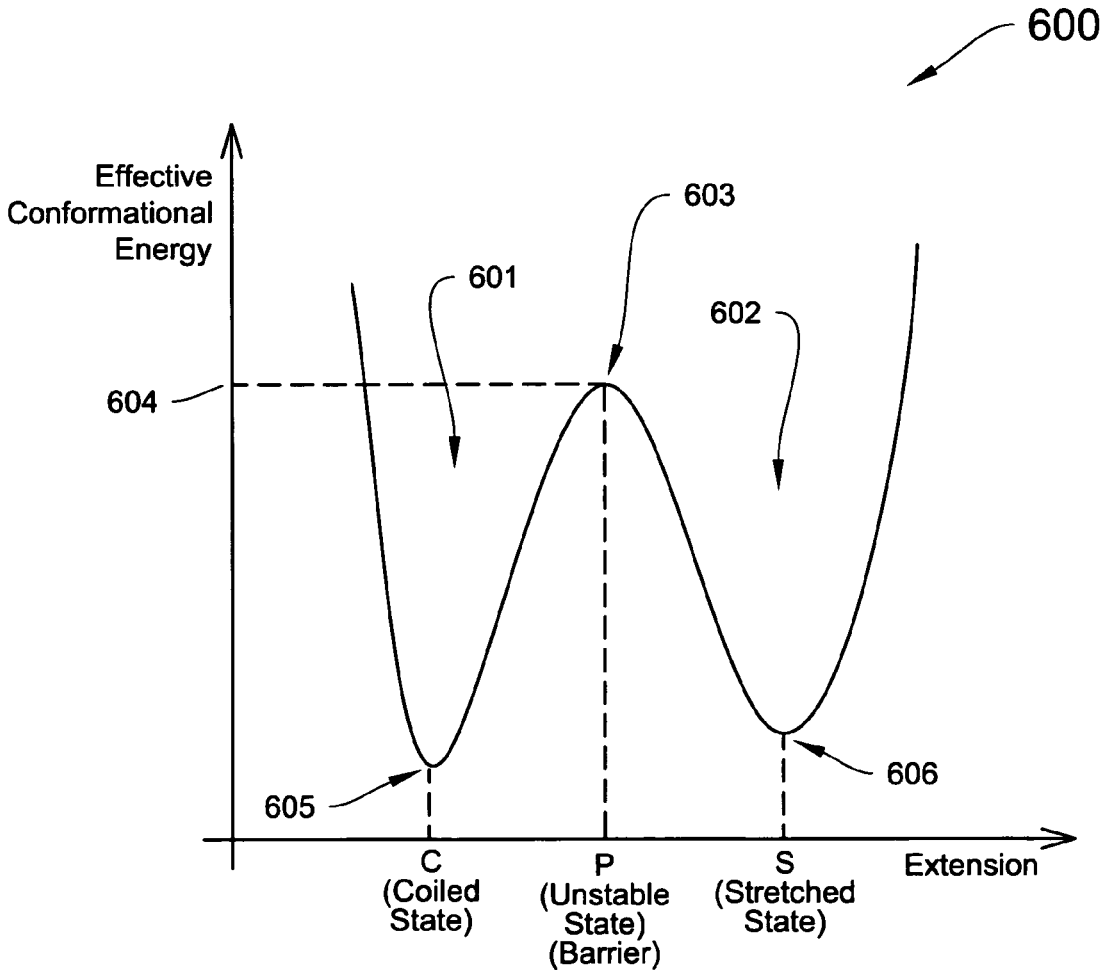
FIG. 6 (Prior Art)
FIG. 6 (Prior Art) is a sketch of a double-well effective free-energy potential depicting the energy states of coiled and stretched polymer states, separated by an energy barrier.

Polymer configuration energy landscapes show a double-well effective free-energy potential near a coil-stretch transition, giving rise to a configuration hysteresis. FIG. 6 depicts an effective free-energy potential curve 600 exhibiting a double-well shape. The horizontal axis denotes fractional polymer extension and the vertical axis represents free energy potential E/kT. Potential well 601 corresponds to the coiled state and potential well 602 to the stretched state of the polymer. An energy barrier 603 separates the coiled and the stretched states, thereby giving the curve 600 its double-well shape. Points C and S denote energy minima corresponding to coiled and stretched states, respectively, whereas P denotes the point at which energy barrier 603 attains its maximum 604. The minima 605 and 606 denote the lowest energy coiled and stretched states, respectively.

An embodiment according to the systems and methods described herein may be used to observe the behavior of a single DNA molecule in a planar extensional flow. Specifically, highly extensible *E. coli* DNA molecules have been visualized using fluorescence microscopy in planar extensional flow. Polymers are observed to exist in kinetically-separated bistable configurations for flow strengths slightly below the coil-stretch transition. Thus, using a device according to the systems and methods described herein, a multi-valued steady-state extension curve with a clear hysteresis region for polymers having initially-coiled or stretched configurations may be found.

Employing a device according to the methods and systems described herein, genomic-length DNA polymer chains with contour lengths L from 1.3 to 1.7 mm were examined. Purified genomic DNA isolated from *E. coli* was generously supplied by U.S. Genomics. The *E. coli* bacterial genome is approximately 4.6 Mega basepairs long and circular, but some of the chains are linearized due to handling. Experiments were conducted by visually inspecting each DNA molecule, to ensure a substantially linear and aberration-free fragment having a proper length in excess of L≈1 mm, before beginning an experiment.

In earlier studies, typical molecule residence times in extensional flows were small (even where a prior-art stagnation device, e.g., the Bentley and Leal four-roll mill device, was employed), with a typical maximum strain ($\epsilon = \dot{\epsilon} t_{obs}$) limit of approximately 5–7. The methods and systems described herein overcome this limitation, at least in part by using an extensional flow network device employing a feedback-controlled stagnation point positioning technique. The methods and systems described herein make possible extremely long observation times—limited primarily by the patience of the experimenter—in a spatially homogeneous extensional flow field.

Furthermore, the methods and systems described herein may employ a nucleic-acid dye, called Sytox Green (Molecular Probes), which provides long-term stability of polymer physical properties, including contour length and relaxation time. Sytox Green dye has a quantum efficiency of 0.53 and peak absorption and emission values at 504 nm 523 nm, respectively. Sytox exhibits an approximately 1000-fold increase in fluorescence intensity upon nucleic acid binding, so free dye in solution is essentially non-fluorescent.

In previous methods involving single-molecule visualization of DNA, molecular dyes from the YO—YO family had been used. These dyes intercalate along the DNA backbone; as photo bleaching occurs, the length of the DNA chain shortens. This complication suffered by prior art techniques is essentially absent from Sytox-labeled DNA used by the methods and systems described herein.

An embodiment according to the methods and systems begins by estimating the ratio of hydrodynamic drag forces in the stretched-to-coiled polymer states by comparing the Zimm-model drag resistivity ($\zeta^{coil}$) for a coiled polymer to the hydrodynamic resistivity for a long, slender body in viscous flow ($\zeta^{stretch}$);

$$\zeta^{stretch}/\zeta^{coil} \approx (N)^{1/2}/ln(L/b)$$

where N is the number of statistical Kuhn segments in the polymer chain, and b is the hydrodynamic radius of the molecule; a numerical constant of order unity has been omitted from this expression. In the limit of very long polymers, $\zeta^{stretch}/\zeta^{coil}$, weakly diverges and hysteresis becomes plausible.

An embodiment according to the methods and systems described herein was used to study highly extensible polymer chains from genomic DNA samples with contour lengths of 1.3 mm and 1.7 mm, such that the drag ratio $\zeta^{stretch}/\zeta^{coil}$ was $\geqq 5$ in a substantially uniform flow. A cross-shaped flow network was constructed using Parafilm spaced between a quartz microscope slide and coverslip, as described previously in relation to FIG. 3. Feedback control of the stagnation point location in the planar extensional flow field was achieved by varying the altitude of one discharge reservoir at fluid receiver 322 with respect to the other 332. Applicants calibrated the planar extensional flow with 0.3 micrometer fluorescent polystyrene beads by tracking bead particle paths over time. An encoded feedback-controlled pump was used to minimize fluctuations. At a constant pump flow-rate, particle paths were tracked without changing the stagnation point location; pump stability was monitored by measuring the fluid strain rate $\dot{\epsilon}$ over time. By fitting the bead positions (r) and velocities (v) to a velocity gradient matrix ($\nabla v$) such that $v=\nabla v^*r$, fluid strain rate $\dot{\epsilon}$ was extracted and a relative error between 2% and 4%, due to variations in the pump motor speed, was found. Next, the stagnation point location was moved through the microscope's field of view while monitoring $\dot{\epsilon}$; it was observed that the extensional flow field remains spatially homogeneous with relative error in $\dot{\epsilon}$ between 2% and 4%, regardless of the zero-velocity position.

Upon satisfactory kinematics and control of the extensional flow field produced by the systems and methods described herein, Applicants characterized the stability of molecular physical properties over time. DNA molecules were imaged using a Micromax 512BFT camera from Roper Scientific, coupled to a Zeiss Axioplan microscope equipped for epifluorescence having a 40×, 1.0 numerical aperture objective oil-immersion lens. A 0.31× demagnifying lens was used to provide a field of view of ≈480 μm. For polymer extensions greater than the camera's field of view, the microscope stage was translated in the direction of molecular stretch to discern total extended lengths. The timescale for translation was on the order of seconds, which was much faster than the timescale of transient molecule dynamics for the range of $\dot{\epsilon}$ probed. DNA polymer molecules around 3 Mega basepairs in length (L≈1300 μm, corresponding to ≈9280 Kuhn segments) were found to have relaxation times around 125 seconds in a 1 cP buffer solution. Polymer relaxation times were measured by first stretching the polymer molecules at high De and then ceasing flow. The molecule end points were tracked over time and the final 30% of the relaxation spectrum was fit to a decaying exponential $\langle X\cdot X\rangle = A\exp(-t/\tau_r)+B$, where X is dimensional polymer extension, $\tau_r$ is the longest polymer relaxation time and A and B are fitting constants. Long observation times $t_{obs}=\epsilon/\dot{\epsilon}$, on the order of hours, were greatly facilitated for fluid strains of around 10 to 15 units. Therefore, a small concentration of background dye was added to the inlet buffer solutions. The fresh dye molecules served to replenish older, photo-bleached dye molecules. Furthermore, a mechanical shutter was used to minimize light exposure from a mercury lamp illuminator and an oxygen-scavenging enzyme system to decrease photo-bleaching. Using the methods and systems described herein, these techniques were combined to achieve stable polymer relaxation times for at least 7 hours of observation of a single DNA molecule. The observation time can be indefinite in length, and is limited primarily by the interests and patience of an observer.

The systems and methods described herein can be employed to facilitate observation of, for example, and without limitation, a molecule subjected to extensional flow, for many units of strain, even for a strain greater than about 10. Polymer extension, too, can be observed under similar conditions, using a device made according to an embodiment of the invention.

Turning to FIGS. 7A–D, sketches of transient polymer extension for DNA in planar extensional flow are shown. Single polymers were maintained near the stagnation point of a device according to the invention, and their relaxation times were characterized. Molecules were prepared in initially-coiled and stretched states at equivalent De values. In this manner, each transient plot represents the response of the same polymer molecule to different initial conditions at the same De.

Figure 7A:
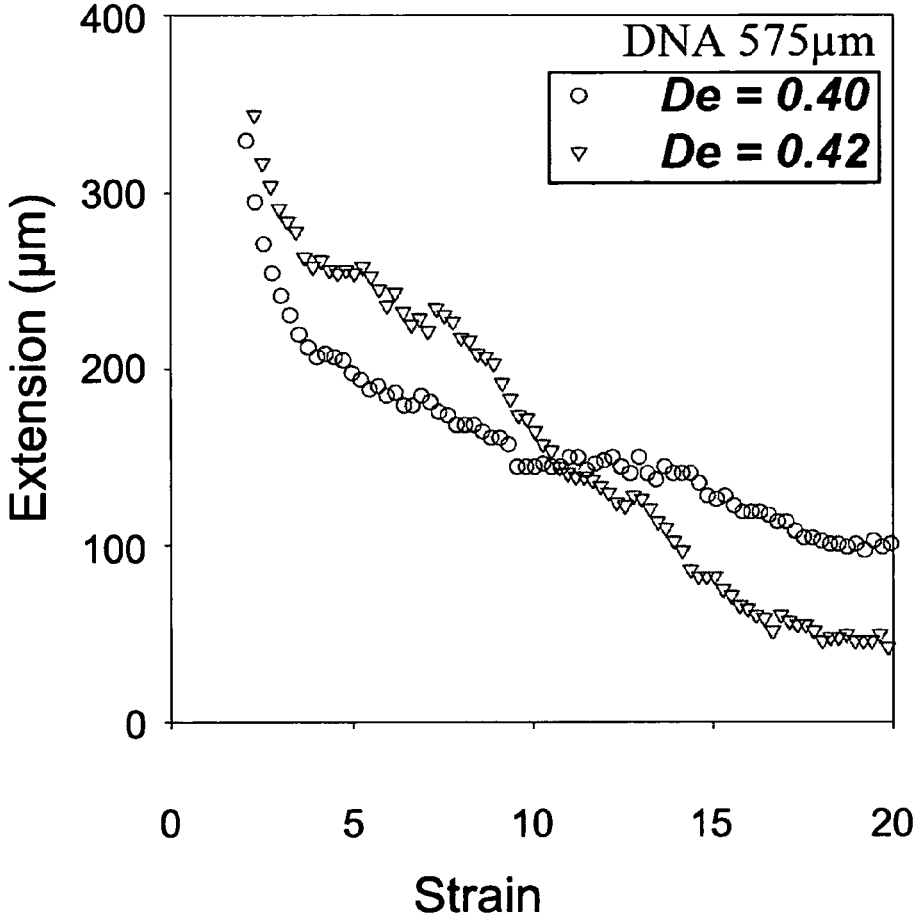
FIGS. 7A–7D depict molecular extensions for DNA in planar extensional flow for various values of De.

In FIG. 7A extensions (vertical axis) of DNA molecules of approximately 575 μm long are plotted against strain (horizontal axis). Configuration hysteresis was not observed at any De for this set of molecules. Trajectories for initially-stretched polymers with L≈575 μm were sluggish to recoil. An initially-stretched molecule with L≈575 μm generally achieved extensions comparable to the initially-coiled state of the same molecule. Initially-stretched molecules at De≈0.4 were slow to recoil with apparent local plateaus and shoulders in transient extension trajectories, generally not observed for a shorter DNA.

Figure 7B:
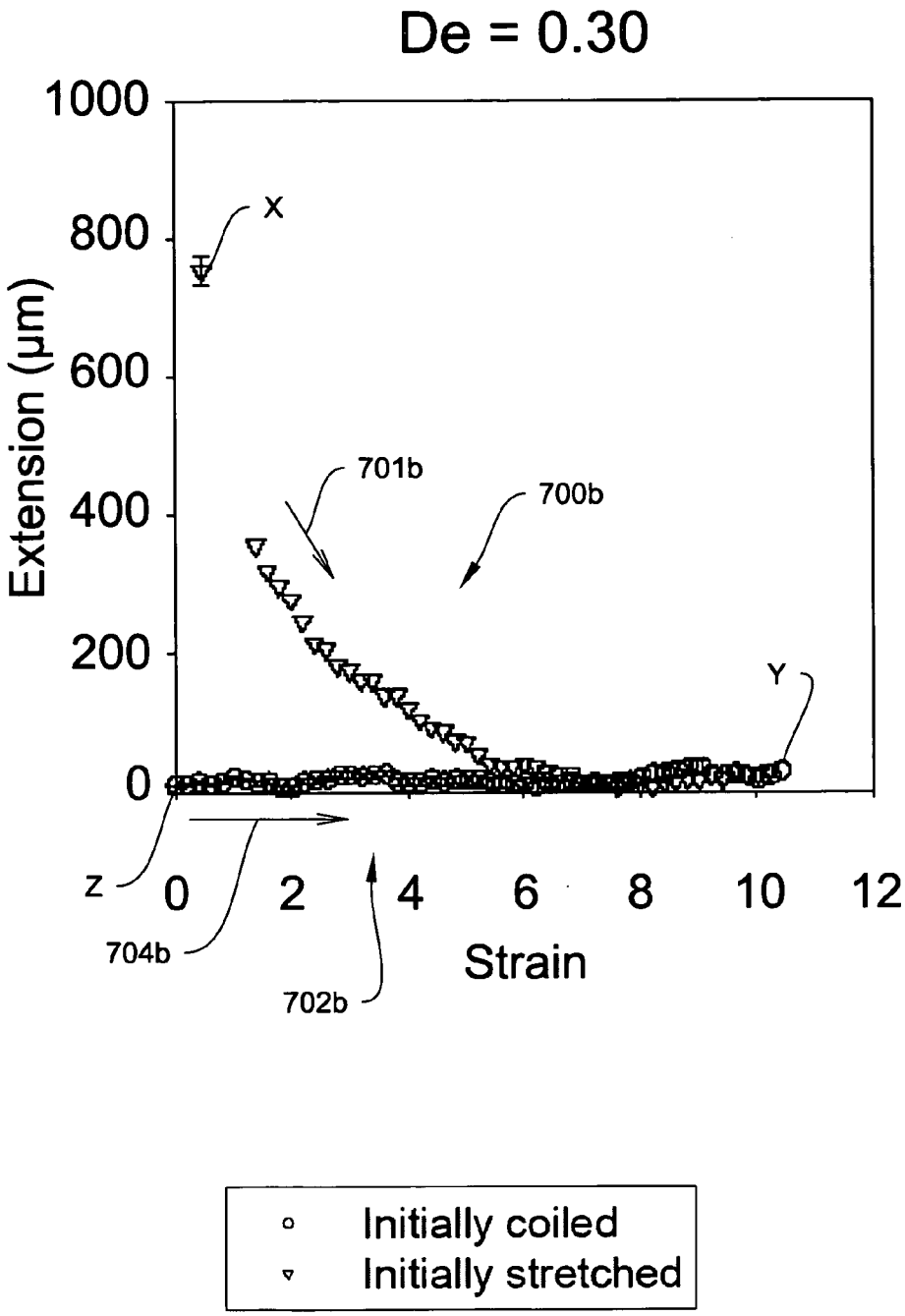
Figure 7C:
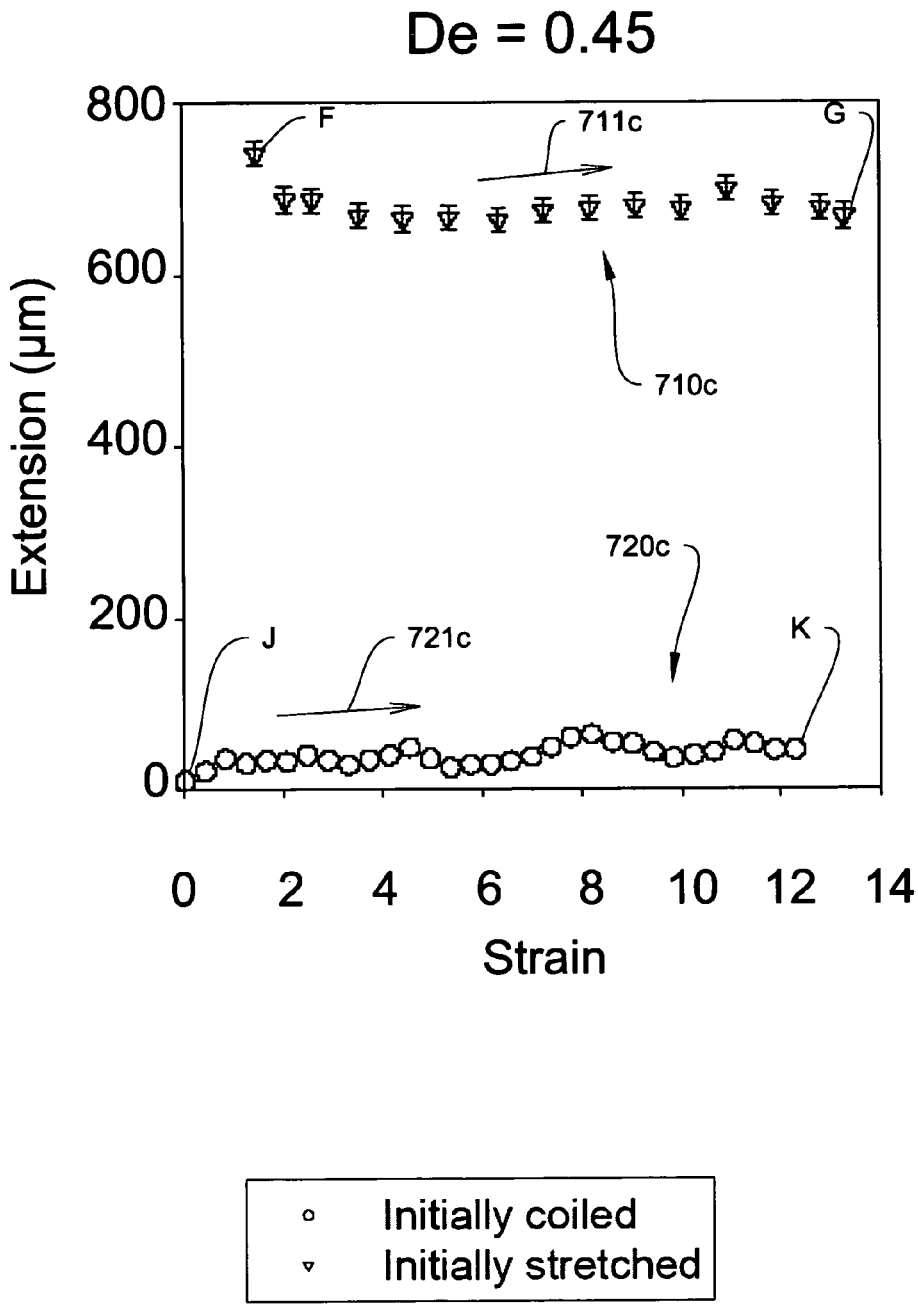
Figure 7D:
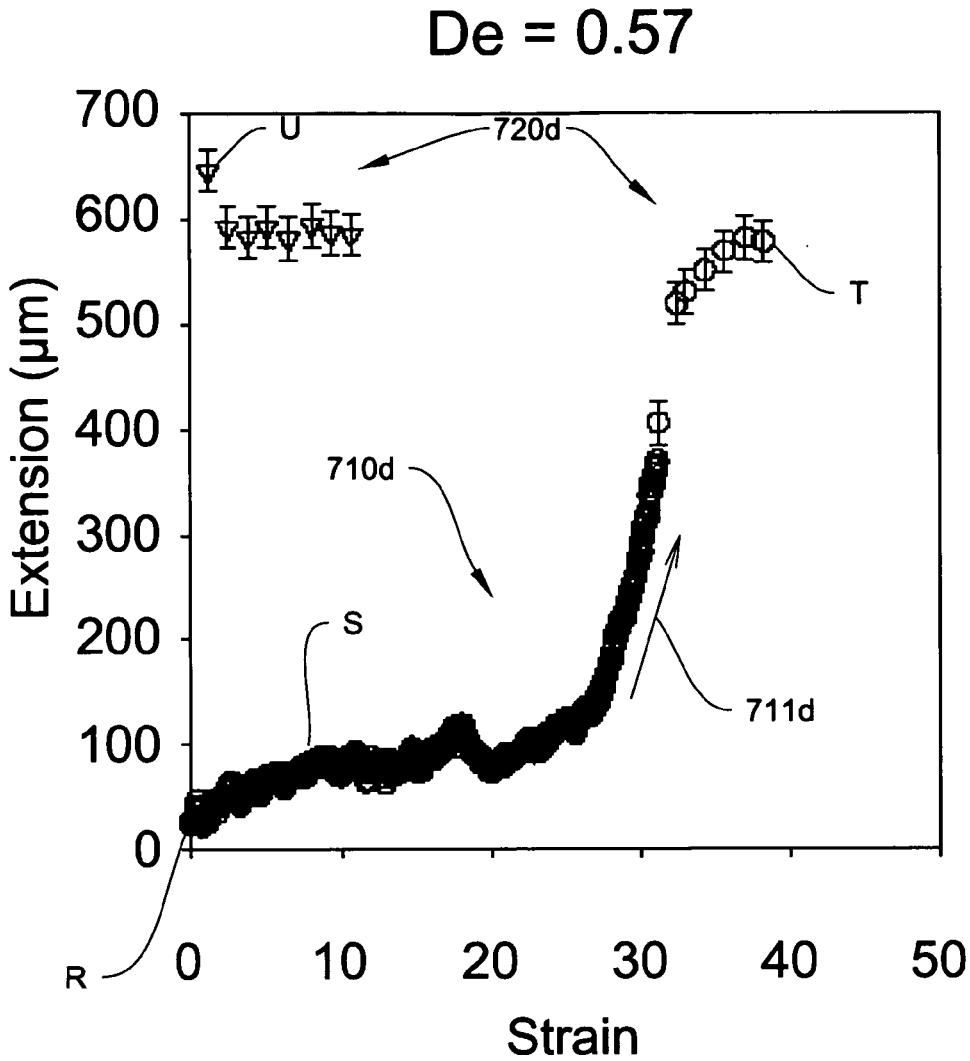
Figure 7D:
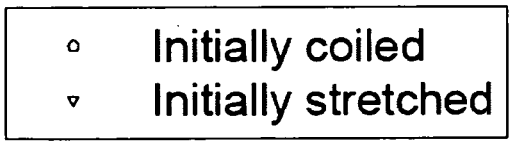

FIGS. 7B–D show the transient extension for DNA molecules with L≈1300 μm at De=0.30, 0.45, and 0.57 (approximately), respectively. Employing a stagnation point device according to the methods and systems described herein, transient experiments were conducted for L≈1300 μm in the same manner as described earlier, by first preparing the molecule in an initially-coiled state, followed by observation of the configuration of the same molecule prepared in an initially-stretched state at substantially the same De.

As FIG. 7B depicts, for low De values of approximately 0.30, the hydrodynamic force exerted on the polymer is not sufficient to maintain an extended configuration. Even though the hydrodynamic drag force is higher in extended conformations, the entropic restoring force succeeds in forcing the polymer back into a coiled configuration. FIG. 7B can be employed to visualize a state transition pathway. In one experiment, the polymer begins in an initially-stretched state, denoted, for example, by point X. An effect of increasing the strain can be seen by following the upper branch 700*b* of the curve from the extended state X, along direction 701*b*, to the coiled state Y. At flow strengths below the coil-stretch transition (De=0.30), initially-stretched molecules collapse to coils, achieving the same extension reached by the same molecule prepared in an initially-coiled state.

This process could be observed in reverse as well. Namely, in an alternative experiment, the polymer begins in an initially-coiled state Z. The initially-coiled polymer remains coiled for about 10 units of applied fluid strain, up to point Y, as can be seen by traversing the lower branch 702*b* of the curve of FIG. 7B along the direction 704*b*.

However, as is shown in FIG. 7C, at De=0.45 slightly below the coil-stretch transition, initially-stretched polymer molecules evolve to extensions ≈670 μm and remain extended to in excess of about 13 units of strain (extended state denoted by point G on the extended state curve 710*c*). The stretched polymer remains in a distinct, kinetically separated state on an upper branch 710*c* of the steady polymer extension curve in FIG. 7C. A polymer in an initially-stretched state represented by the data curve 710*c* stays on the curve 710*c*, transitioning from point F, along direction 711*c*, to point G, as the strain increases. The same molecule prepared in an initially-coiled state denoted by the data curve 720*c* remains at coiled extensions near 41 $\mu$m over the course of about 12 strain units, over which time fluid elements separate by a relative distance of about $e^{12}$. The polymer in a coiled state represented by the point J transitions along the data curve 720*c* to the point K, along the direction 721*c* for increasing strain. These states remain distinct and are separated by an extension of approximately 630 $\mu$m, approximately ½ L for over 30 relaxation times (between the curves 710*c* and 720*c*).

At this De, data collected by an embodiment of the systems and methods described herein indicates that two effective conformational energy minima exist for polymer extension, and the energy barrier height is several kT, such that a random Brownian fluctuation does not cause either state to become unpopulated over the course of about $\epsilon$=12 ($t_{obs}\approx$1 hour).

FIG. 7D depicts transient dynamics of long-chain polymer molecules for De greater than a critical value. For De=0.57, the molecule initially prepared in the coiled state R eventually unravels to equivalent extensions for the initially-stretched polymer, along the direction 711*d* to the point T on the upper branch 720*d*.

Unlike trajectories for De$\leqq$0.5 (approximate right-hand bound), the initially-coiled state (e.g., point R on curve 710*d*) exhibits a substantially monotonic increase in extension up to about $\epsilon$=10 (the point S on the curve 710*d*), whereupon the extension reached is approximately 100 $\mu$m. Slight perturbations in conformation cause an unshielding of the monomer units from the flow, gradually enhancing the hydrodynamic drag exerted on the polymer by the solvent, and eventually causing the polymer to unravel to a final length of approximately 580 $\mu$m for fluid strains of 25 (the point T). Eventually, the molecule becomes sufficiently free-draining and unravels to a steady extension of approximately 580 $\mu$m. The unraveling process for De slightly above the coil-stretch transition is retarded due substantially to hydrodynamic shielding of monomer units in the interior of the coiled polymer; a gradual perturbation of conformation is the primary mechanism by which the polymer is unshielded from the solvent. The device according to the systems and methods described herein has significantly facilitated the observations depicted by FIGS. 7B–7D, and provides a distinct advantage over the four-roll mill device of Bentley and Leal. For example, as mentioned earlier, employing a device according to the systems and methods disclosed herein, a DNA molecule can be trapped indefinitely; upwards of about 7–8 hours may be routinely performed, using a system according to the invention. This is possible at least partially because fresh fluid containing fresh dye and agents could be introduced into the flow paths, thereby significantly retarding or blocking the oxidative degradation of the fluorescent dye on the DNA. The Bentley/Leal device, having four rollers rotating in a bath of fluid is not suitable for the kinds of observations shown in, and described in relation to, FIGS. 7A–7D, at least partially because the fluid bath cannot be readily refreshed to avoid degeneration of the DNA molecule over long observation times. Moreover, imaging a stagnated DNA molecule, for example, is substantially easier for a device according to the systems and methods disclosed herein than it is for the Bentley/Leal four-roll mill. For example, to observe a planar extensional flow, a user of the four-roll mill device of Bentley/Leal may have to focus far into the fluid and away from the walls; this poses a serious challenge for the optics used to observe the stagnated DNA molecule. Additionally, using a device according to the systems and methods described herein, low-light imaging of fluorescence microscopy of a DNA molecule in a controlled extensional flow with stagnation point control is greatly facilitated. As mentioned above, the Bentley/Leal device has nontrivial optical hurdles to overcome even in the absence of a low-light environment.

In yet another variety of applications, a stagnation point control device according to the methods and systems described herein may be applied as a general tool for long observation time imaging studies on the microscale. Object trapping in a solution away from surfaces is accomplished without the use of optical tweezers or micro-pipettes, and generally does not require complicated optics. Even with a simple computer-controlled feedback system, a single molecule of DNA may be trapped effectively indefinitely. Furthermore, the sample under observation need not be modified to include a trapping center (e.g. tethering a microbead to the molecule of interest), which has the potential disadvantage of introducing perturbations in some systems. Also, environmental conditions may be altered by injecting, or otherwise introducing, solutions having a plurality of properties (e.g. ionic strengths, enzyme concentrations, etc.), while keeping the molecule of interest trapped in the field of observation of a sensing device (e.g., field of view of an imaging device, such as a microscope). Therefore, the methods and systems described herein have applications in single-DNA molecule stretching and fluorescent imaging in dilute solution, which is an emerging method of genome sequencing currently under development (R. Buderi, Ed., *Tech. Review November* 2002, 76 (2002)).

Further details pertaining to "Observation of Polymer Conformation Hysteresis in Extensional Flow" may be found in an article, bearing the same title, by Applicants, published in the 12 Sep. 2003 issue of Science Magazine, vol. 301, pp. 1515–1519. The contents of the cited Science Magazine article are incorporated herein by reference, in entirety.

In one illustrative embodiment, a device according to the systems and methods described herein can be used to study a flow-enhanced chemical and/or biological reaction. Recently, it has been demonstrated that lambda phage DNA molecules may efficiently assemble in shear flow (C. Haber and D. Wirtz, *Biophysical Journal*, vol. 79, 1530–1536). Lambda DNA is approximately 48 kilobases in length and has single-stranded "overhangs" on each end, comprising sequences of 12 complementary bases. It has been shown that lambda DNA (at concentrations of approximately 0.05 mg/mL) assemble into concatemers up to at least about 194 kilobases in length (resolved by pulsed field gel electrophoresis) when exposed to shear flow at shear rates of about 100 $s^{-1}$. It is expected that flow-induced deformation of the DNA molecules increases the probability of encounter of the complementary base pair sequences on different DNA molecules in solution. The shear-induced assembly of lambda DNA is merely one example of hydrodynamic fluid flow enhancing the progression of a chemical reaction.

The stagnation point device made according to the systems and methods described herein can be used to study flow-enhanced reactions in extensional flow. The flow-enhanced reactions may occur upstream of the stagnation point, or near the stagnation point at or about the study area. If the flow-enhanced reaction occurs at or about the study area, the progression of the reaction may be observed in real time with a sensing device, such as, without limitation, an imaging device. If the flow-enhanced reaction occurs upstream of the stagnation point, then in one illustrative embodiment, detection using the stagnation device includes introducing mixtures of wild-type DNA and DNA with a known gene sequence (tagged with a fluorescent dye) upstream of the stagnation area. If the "test" gene is complementary to a given linear sequence on the wild-type DNA, binding of the sequences can occur, aided by the fluid flow. In one illustrative embodiment, downstream detection is performed by imaging single molecules of fluorescently-labeled DNA sufficiently stretched in the stagnation/study area of the stagnation point device. By examining a subpopulation of stretched DNA molecules, the stagnation device made according to the systems and methods described herein can be used to determine whether the desired base pair sequence is present.

More generally, the systems and methods described herein provide a controlled (e.g., feedback-controlled) stagnation of an object within a study region, for an indefinite length of time, and are useful for research and development in a number of fields—in academic as well as industrial settings. These fields include, but are not limited to, life sciences, physical sciences, and engineering. Life sciences, as used herein, is an umbrella term to encompass, without limitation, subject matter spanning any subset of the biological, chemical, and biomedical sciences; examples of these are biology, chemistry, biotechnology, pharmaceuticals, biomedical technologies, life systems technologies, nutraceuticals, cosmeceuticals, food processing, environmental sciences, biomedical devices, and, in general, a field of research, development, manufacturing, or a combination thereof, having to do with organisms, such as plants and animals (including humans) or other life forms, such as microorganisms. Physical sciences can include physics, materials science, astronomy, earth sciences, and others. Engineering applications of the systems and methods described herein include biomedical engineering, mechanical engineering, fluid dynamics, aeronautics, astronautics, chemical engineering, electrical engineering, etc.

Several different nomenclatures have been used herein to refer to a device made according to the invention. The following terms all refer to such a device, and have been used interchangeably herein: stagnation network, stagnation network device, stagnation flow network, stagnation flow device, stagnation point device, stagnation point control device, controlled stagnation point device, flow network stagnation device, stagnation device, flow stagnation device, object confinement device, and network. One of ordinary skill in the art should be able to ascertain from the context whenever a device using the systems and methods disclosed herein is referred to herein.

The contents of all references, patents and published patent applications cited throughout this Application, as well as their associated figures are hereby incorporated by reference in entirety.

Those skilled in the art will recognize, or be able to ascertain using no more than routine experimentation, many equivalents to the specific embodiments of the invention and the specific methods and practices associated with the systems and methods described herein. Accordingly, it will be understood that the invention is not to be limited to the embodiments, methods, and practices disclosed herein, but is to be understood from the following claims, which are to be interpreted as broadly as allowed under the law.

What is claimed is:

1. A method of confining an object to a region of a fluid in motion, comprising:

a. carrying the fluid into the region by at least one inlet;

b. carrying the fluid out of the region by at least one outlet; and c. adjusting the motion of the fluid to produce a flow stagnation point in the region, to discourage the object from leaving the region.

2. The method of claim 1, wherein the adjusting includes pressure-driving the fluid.

3. The method of claim 1, wherein the object comprises a macromolecule.

4. The method of claim 1, wherein the object comprises a biomolecule.

5. The method of claim 1, wherein the object comprises a marker for facilitating detection of the object.

6. The method of claim 1, wherein the object comprises a colloidal particulate.

7. The method of claim 6, wherein the object is selected from the group consisting of: a liquid droplet, a semi-solid droplet, a solid droplet, a gaseous bubble, a viscoelastic gel composition, and any combination thereof.

8. The method of claim 1, including adjusting viscosity of the fluid.

9. The method of claim 8, wherein the viscosity is adjusted to manipulate at least one of the object and a pattern of the flow.

10. The method of claim 1, including adjusting a temperature of the fluid.

11. The method of claim 10, wherein the temperature is adjusted to manipulate the object.

12. The method of claim 10, wherein adjusting the temperature includes coupling a heater and a portion of a combination of the at least one inlet and the at least one outlet.

13. The method of claim 12, wherein the coupling includes disposing the heater substantially along a surface of the portion.

14. The method of claim 12, wherein the coupling includes disposing the heater substantially inside a portion of the at least one inlet.

15. The method of claim 12, wherein the coupling includes disposing the heater substantially inside a portion of the at least one outlet.

16. The method of claim 10, wherein adjusting the temperature includes altering a temperature of the fluid prior to supplying the fluid to the at least one inlet.

17. The method of claim 1, wherein the fluid comprises a liquid.

18. The method of claim 1, wherein the fluid comprises a gas.

19. The method of claim 1, wherein the fluid comprises an aqueous solution.

20. The method of claim 1, wherein the fluid comprises a non-aqueous solution.

21. The method of claim 1, wherein the fluid comprises an electrolytic solution.

22. The method of claim 1, wherein the fluid comprises an agent to manipulate the object.

23. The method of claim 22, wherein the agent is selected from the group consisting of: biological agent, chemical agent, biochemical agent, magnetic agent, and any combination thereof.

24. The method of claim 1, including adjusting a hydrokinetic force of the flow to produce a distortion of the object.

25. The method of claim 1, wherein the motion of the fluid is adjusted for manipulation of the object.

26. The method of claim 25, wherein the manipulation comprises a physical manipulation.

27. The method of claim 26, wherein the physical manipulation is selected from the group consisting of: an alignment of the object, a stretching of the object, a slicing of the object, a rotation of the object, a translation of the object, an exposure to a pressure modulation of the fluid, and any combination thereof.

28. The method of claim 27, wherein the rotation comprises a conformational rotation.

29. The method of claim 27, wherein the translation comprises a conformational translation.

30. The method of claim 1, wherein the adjusting is performed by a controller having fluidic communication with at least one of the at least one inlet and the at least one outlet.

31. The method of claim 30, wherein the controller adjusts resistance to fluid flow in at least one of the at least one outlet, thereby adjusting the motion of the fluid.

32. The method of claim 31, including adjusting a rate of drainage of the fluid from a first outlet of the at least one outlet.

33. The method of claim 32, wherein adjusting the rate of drainage includes providing a first exit port disposed at the first outlet.

34. The method of claim 33, including providing a first valve for the first exit port.

35. The method of claim 34, including controlling an operation of the first valve by the controller.

36. The method of claim 33, including providing a first reservoir in fluidic communication with the first exit port, the first reservoir having a first altitude and collecting the fluid carried by the first outlet.

37. The method of claim 36, including adjusting the first altitude, to adjust fluidic resistance exerted by the first reservoir on fluid attempting to drain from the first outlet.

38. The method of claim 37, wherein the controller adjusts the first altitude based on location information associated with the stagnation point.

39. The method of claim 38, including conveying the location information to the controller by using a feedback mechanism.

40. The method of claim 36, including providing a second outlet and a second reservoir having a second altitude, being in fluidic communication with the second outlet, and receiving the fluid from the second outlet.

41. The method of claim 40, including adjusting the second altitude to adjust fluidic resistance exerted by the second reservoir against fluid attempting to drain from the second outlet.

42. The method of claim 39, including fixing the second altitude.

43. The method of claim 1, including providing a sensing device to capture a representation of the object.

44. The method of claim 43, wherein the sensing device includes an imaging device.

45. The method of claim 43, wherein the representation is a visual representation.

46. The method of claim 43, including providing a recording device for storing the representation.

47. The method of claim 46, including providing a computer programmed for analyzing the visual representation.

48. The method of claim 47, including programming the computer to detect the object in the region.

49. The method of claim 47, including programming the computer to track the object.

50. Apparatus for confining an object to a predetermined region of a fluid in motion, comprising:

a. at least one inlet for carrying the fluid into the region;

b. at least one outlet for carrying the fluid out of the region; and c. a controller in fluidic communication with at least one of the at least one inlet and the at least one outlet, for adjusting the motion of the fluid to produce a flow stagnation point in the region, to discourage the object from leaving the region.

51. The apparatus of claim 50, wherein the adjusting includes pressure-driving the fluid.

52. The apparatus of claim 50, wherein the motion of the fluid comprises a laminar flow.

53. The apparatus of claim 50, wherein the motion of the fluid comprises a turbulent flow.

54. The apparatus of claim 50, wherein at least one of the at least one inlet comprises a microfluidic artery.

55. The apparatus of claim 50, wherein at least one of the at least one outlet comprises a microfluidic artery.

56. The apparatus of claim 50, wherein at least one of the region, the at least one inlet, and the at least one outlet has an average depth of approximately 60 to approximately 1000 microns.

57. The apparatus of claim 50, wherein at least one of the region, the at least one inlet, and the at least one outlet is formed in a substrate comprising a substance selected from the group consisting of: glass, plastic, resin, silicon, polydimethylsiloxane (PDMS), and any combination thereof.

58. The apparatus of claim 50, wherein the controller comprises at least one flow deflector disposed in at least one of the region, the at least one inlet, and the at least one outlet, to guide the fluid in accordance with a predetermined flow pattern.

59. The apparatus of claim 50, wherein at least one of the region, the at least one inlet and the at least one outlet is constructed by cutting a pattern onto a stack of a number of thin-film sheets, and sandwiching the sheets between a first substantially rigid planar surface and a second substantially rigid planar surface.

60. The apparatus of claim 50, wherein the apparatus has a first inlet and a second inlet.

61. The apparatus of claim 60, wherein the first inlet and the second inlet are disposed to carry opposing flow patterns into the region.

62. The apparatus of claim 50, wherein the apparatus has a first outlet and a second outlet.

63. The apparatus of claim 62, wherein the first outlet and the second outlet are disposed to carry fluid in substantially opposite, diverging directions.

64. The apparatus of claim 50, wherein the apparatus comprises a first inlet, a second inlet, a first outlet, and a second outlet.

65. The apparatus of claim 64, wherein the first inlet and the second inlet are disposed to carry opposing flow patterns into the region.

66. The apparatus of claim 65, wherein the first outlet and the second outlet are disposed to carry the fluid in substantially opposite, diverging directions.

67. The apparatus of claim 64, wherein at least one of the first inlet and the second inlet is disposed to carry fluid in a direction substantially perpendicular to a direction of the flow carried by at least one of the first outlet and the second outlet.

68. The apparatus of claim 64, wherein at least one of the first inlet and the second inlet is disposed to carry fluid along a direction substantially non-perpendicular to a direction of the flow carried by at least one of the first outlet and the second outlet.

69. The apparatus of claim 50, wherein the controller comprises a means for adjusting resistance to fluid flow in at least one of the at least one outlet, to adjust the motion of the fluid.

70. The apparatus of claim 69, wherein the means for adjusting resistance comprises a means for adjusting a rate of drainage of the fluid from a first outlet of the at least one outlet.

71. The apparatus of claim 70, wherein the means for adjusting a rate of drainage of the fluid comprises a first exit port disposed in the first outlet.

72. The apparatus of claim 71, wherein the first exit port comprises a first valve.

73. The apparatus of claim 72, wherein the first valve is controllable by the controller.

74. The apparatus of claim 71, wherein the first exit port is in fluidic communication with a first reservoir having a first altitude and collecting the fluid carried by the first outlet.

75. The apparatus of claim 74, wherein the means for adjusting resistance comprises a means for adjusting the first altitude, to adjust fluidic resistance exerted by the first reservoir against the fluid attempting to drain from the first outlet.

76. The apparatus of claim 75, wherein the first altitude is adjusted by the controller, based on location information, associated with the stagnation point, fed back to the controller.

77. The apparatus of claim 74, comprising a second outlet and a second reservoir in fluidic communication with the second outlet, receiving the fluid drained from the second outlet, and having a second altitude.

78. The apparatus of claim 77, wherein the means for adjusting resistance comprises a means for adjusting the second altitude.

79. The apparatus of claim 77, wherein the second altitude is fixed.

80. The apparatus of claim 50, comprising an imaging device to capture a visual representation of the object.

81. The apparatus of claim 80, wherein the imaging device is selected from the group consisting of: a fluorescent microscope, an atomic force microscope (AFM), an optical microscope, a sonar imager, a radar imager, and any combination thereof.

82. The apparatus of claim 80, comprising a recording device for storing the visual representation captured by the imaging device.

83. The apparatus of claim 82, wherein the recording device comprises a camera.

84. The apparatus of claim 82, wherein the recording device comprises a charge-coupled device (CCD).

85. The apparatus of claim 82, comprising a computer for analyzing the visual representation.

86. The apparatus of claim 85, wherein the computer includes a means for detecting the object in the region.

87. The apparatus of claim 86, wherein the means for detecting comprises a computer-executable instruction set for processing the visual representation.

88. The apparatus of claim 85, wherein the computer includes a means for tracking the object.

89. The apparatus of claim 88, wherein the means for tracking comprises a computer-executable instruction set for processing the visual representation.

* * * * *